US008876335B2

(12) United States Patent
Clark et al.

(10) Patent No.: US 8,876,335 B2
(45) Date of Patent: Nov. 4, 2014

(54) WORKSPACE LIGHTING SYSTEM

(71) Applicants: Finelite Inc., Union City, CA (US); University of California, David, Oakland, CA (US)

(72) Inventors: Walter Blue Clark, Palo Alto, CA (US); Douglas Joseph Scott Bourne, Mountain View, CA (US); Erik R. Page, Fairfax, CA (US); Michael Siminovitch, Woodland, CA (US); Kevin Gauna, Berkeley, CA (US); Konstantinos Papamichael, Davis, CA (US)

(73) Assignees: Finelite Inc, Union City, CA (US); The Regents of the University of California, Oakland, CA (US)

( * ) Notice: Subject to any disclaimer, the term of this patent is extended or adjusted under 35 U.S.C. 154(b) by 0 days.

(21) Appl. No.: 14/120,150

(22) Filed: Apr. 30, 2014

(65) Prior Publication Data

US 2014/0232267 A1 Aug. 21, 2014

Related U.S. Application Data

(63) Continuation of application No. 13/136,448, filed on Aug. 3, 2011, now abandoned, which is a continuation (Continued)

(51) Int. Cl.
*F21V 29/00* (2006.01)
*H05B 33/08* (2006.01)

(Continued)

(52) U.S. Cl.
CPC ..... *H05B 33/0842* (2013.01); *F21S 2/00* (2013.01); *F21S 6/003* (2013.01); *F21V 29/2243* (2013.01); *F21V 29/2293* (2013.01); *F21V 29/2206* (2013.01); *F21V 21/28* (2013.01); *F21V 23/0442* (2013.01); *F21V 29/004* (2013.01); *F21W 2131/402* (2013.01); *F21Y 2101/02* (2013.01)
USPC ..... 362/294; 362/236; 362/613; 362/631; 362/632; 315/149; 315/312

(58) Field of Classification Search
CPC ..... F21S 2/00; F21S 6/003; F21V 29/2293; F21V 29/2243; F21V 29/004; F21V 23/0442; F21W 2131/402; F21Y 2101/02; H05B 33/0842
USPC ..... 315/312, 316, 291, 307, 169.3, 134, 315/149, 159; 362/33, 84, 240, 555, 362/611–613, 630–634, 276, 127, 149, 236, 362/800, 294
See application file for complete search history.

(56) References Cited

U.S. PATENT DOCUMENTS 7,145,125 B2 * 12/2006 May et al. ..... 250/228
8,016,457 B2 * 9/2011 Clark et al. ..... 362/294

(Continued)

*Primary Examiner* — Haiss Philogene
(74) *Attorney, Agent, or Firm* — James A. Gavney, Jr.; JAG Patent Services

(57) ABSTRACT

A modular lighting system for lighting a work area is disclosed. The system includes a power supply with power outlets for powering LED fixtures. The power supply preferably operates at or below a fixed power output level, such as to illuminate the work area using less than 0.2 Watts per square foot of energy. The lighting system also includes an occupancy sensor and/or a light level sensor for controlling lighting levels in the work area in response to detection of a person, ambient light levels and/or a combination thereof. The lighting system can also include computer unit with a microprocessor and a memory unit for running software or firmware the executes lighting programs, stores light usage histories and/or provides system reports to a remote computer by a wireless means and/or over a computer network.

18 Claims, 23 Drawing Sheets

Related U.S. Application Data of application No. 11/801,856, filed on May 10, 2007, now Pat. No. 8,016,457, which is a continuation-in-part of application No. 11/432,036, filed on May 10, 2006, now abandoned.

(60) Provisional application No. 60/680,890, filed on May 12, 2005, provisional application No. 60/859,674, filed on Nov. 17, 2006.

(51) Int. Cl.

| | |
|---|---|
| ***F21S 2/00*** | (2006.01) |
| ***F21S 6/00*** | (2006.01) |
| *F21V 21/28* | (2006.01) |
| *F21V 23/04* | (2006.01) |
| *F21W 131/402* | (2006.01) |
| *F21Y 101/02* | (2006.01) |

(56) References Cited

U.S. PATENT DOCUMENTS

| | | | | |
|---|---|---|---|---|
| 8,080,819 | B2 * | 12/2011 | Mueller et al. | 257/13 |
| 8,193,789 | B2 * | 6/2012 | Bayat et al. | 323/276 |
| 8,207,821 | B2 * | 6/2012 | Roberge et al. | 340/9.11 |

* cited by examiner

WORKSPACE LIGHTING SYSTEM

RELATED APPLICATIONS

This application is a Continuation Application of the co-pending U.S. patent application Ser. No. 13/136,448 title "WORKSPACE LIGHTING SYSTEM", filed Aug. 3, 2011, which is a Continuation Application of the co-pending application Ser. No. 11/801,856 titled "WORKSPACE LIGHTING SYSTEM", filed May 10, 2007 now U.S. Pat. No. 8,016,457 issued Sep. 13, 2011, which is a Continuation-in-Part Application of the co-pending application Ser. No. 11/432,036, titled "WORKSPACE LIGHTING SYSTEM", filed May 10, 2006, now abandoned, which claims priority under 35 U.S.C. 119 (e) of the U.S. Provisional Patent Application Ser. No. 60/680,890, filed May 12, 2005, and titled "PERSONAL LIGHTING SYSTEM" and U.S. Provisional Patent Application Ser. No. 60/859,674, filed Nov. 17, 2006, and titled "WORKSPACE LIGHTING." The U.S. patent application Ser. No. 13/136,448 title "WORKSPACE LIGHTING SYSTEM" filed Aug. 3, 2011 the U.S. patent application Ser. No. 11/801,856 titled "WORKSPACE LIGHTING SYSTEM", filed May 10, 2007, now U.S. Pat. No. 8,016,457, the U.S. patent application Ser. No. 11/432,036, titled "WORKSPACE LIGHTING SYSTEM", filed May 10, 2006, now abandoned, the U.S. Provisional Patent Application Ser. No. 60/680,890, filed May 12, 2005, and titled "PERSONAL LIGHTING SYSTEM", and the U.S. Provisional Patent Application Ser. No. 60/859,674, filed Nov. 17, 2006, and titled "WORKSPACE LIGHTING", are all hereby incorporated by reference.

FIELD OF THE INVENTION

This invention relates to the field of interior lighting. More particularly, this invention relates to a device for work area illumination comprising luminaires, power supply, and lighting controls.

BACKGROUND OF THE INVENTION

Illumination is provided using many types of light sources and distribution methods. In interior office lighting, illumination is typically provided through a combination of overhead luminaires and task lighting. Existing best practices and governmental standards proscribe a fixed total amount of energy per unit area illuminated for these two lighting types. Overhead lighting is well understood. High-quality, suspended, direct-indirect lighting can meet or exceed these goals in virtually every situation. Task lighting is more complicated and usually not deeply discussed in guidelines or regulations.

In addition, the demographics of American society indicate that the workforce is aging. The eye deteriorates with age and older workers may require as much as twice as much light to perform the same task as a younger worker. Appropriate task lighting can assist these workers and make them more productive, without lighting the entire space to an unnecessarily high level.

Task lamps vary widely in shape, performance, cost, and efficiency leading to a bewildering array of options. Also, the portability of task lamps makes them prone to loss or theft. Lighting designers, architects, and engineers have traditionally been unwilling to depend on task lighting for illumination. Without a method of verifying appropriate task lighting, the overhead lighting must be over-designed to ensure proper light levels.

Under-cabinet lights have also used as task lights to increase desk illumination. These lights are not suited for this application. A typical task, such as a single piece of paper, is fundamentally different in size and shape from a typical cabinet. Under-cabinet lights are either too large to efficiently illuminate a task, or too small to fully illuminate the under-cabinet wall.

Beyond the difficulty of selecting and maintaining task lights, there are fundamental energy concerns. Fluorescent tubes or compact fluorescent bulbs have been the most efficient and cost effective technology for task lighting. These sources are only available in a fixed number of packages, and cannot be subdivided into smaller energy loads. The lowest level of the existing packages is relatively high and this leads to over-illumination of task, and potentially illuminance uniformity issues across the space. More simply, there are both lighting quality and energy efficiency drawings to having a single over-illuminated area in a work space. Mandating a single type of lamp for an entire office may lead to small workstations being over-lit and larger workstations have sections of brightness juxtaposed with darker areas. Due to these issues, task lighting has not gained broad acceptance in the building or lighting communities as a reliable tool for increasing light levels in an office space.

Many alternate technologies exist to light workplaces. In particular, LED technology has improved greatly in the past years and has become viable as a solution for targeted applications in the field of general illumination. The existing LED products in the market are designed as direct replacements for existing products, such as task, accent, or under-cabinet lights. These solutions are typically unsatisfactory due to the high cost of LEDs relative to other light source.

SUMMARY OF THE INVENTION

The present invention is directed to a lighting system for lighting cubicles or other work areas. The system includes a direct current (DC) power supply with a plurality of power outlets for powering a corresponding plurality of light fixtures (or luminaires). The light fixtures are equipped with plug features that detachably plug into one or more of the power outlets. The light fixtures are preferably need specific, such that each of the light fixtures provides a unique lighting function and/or photometric response. For example, the plurality of light fixtures can include light fixtures that provide task lighting, accent lighting, under-cabinet lighting and wall wash lighting. Preferably, the light fixtures have light emitting diode (LED) arrays and heat sinks to cool the LED arrays while the light fixtures are on.

In accordance with the embodiments of the invention, the power supply is configured to have a selectable or fixed power output level, such that the total power that is provided by any one of the power outlets and/or the sum of the power outlets is maintained at or below the selected or the fixed power output level. The plug features of the light fixtures can be coded, shaped or otherwise matched to fit into or engage specific power outlets on the power supply. Alternatively, the plug features are universal plug features that can be plugged into any one of the power outlets on the power supply. In further embodiments of the invention the light fixtures and/or the plug features are coded and/or matched to fit into or engage specific power outlets on the power supply based on an intended use or photometric response of each specific light fixtures. The modular construction the lighting system described above allows the power supply or any one of the light fixtures to be exchanged or replaced with a new one when necessary without requiring that the entire lighting system be replaced.

In accordance with further embodiments of the invention, a the lighting system, in addition to a manual switch, includes a sensor that is configured to turn on and off the lighting system. For example, the lighting system includes an ultrasonic or infrared occupancy sensor that turns on the lighting system in response to detection of a person in a vicinity of the lighting system and turns off the lighting system at a time after that presence of the person is no longer detected by the sensor. In accordance with still further embodiments of the invention, the lighting system includes a light level sensor and the system adjusts the power output level of the power supply based on the amount light measured.

The lighting system of the present invention can also include a computer unit with a micro-processor and a memory unit for running software or firmware that execute lighting programs, stores lighting usage histories and/or provides system reports to a remote computer linked by a wireless means and/or over a computer network.

DETAILED DESCRIPTION OF THE PREFERRED EMBODIMENT

Figure 1A:
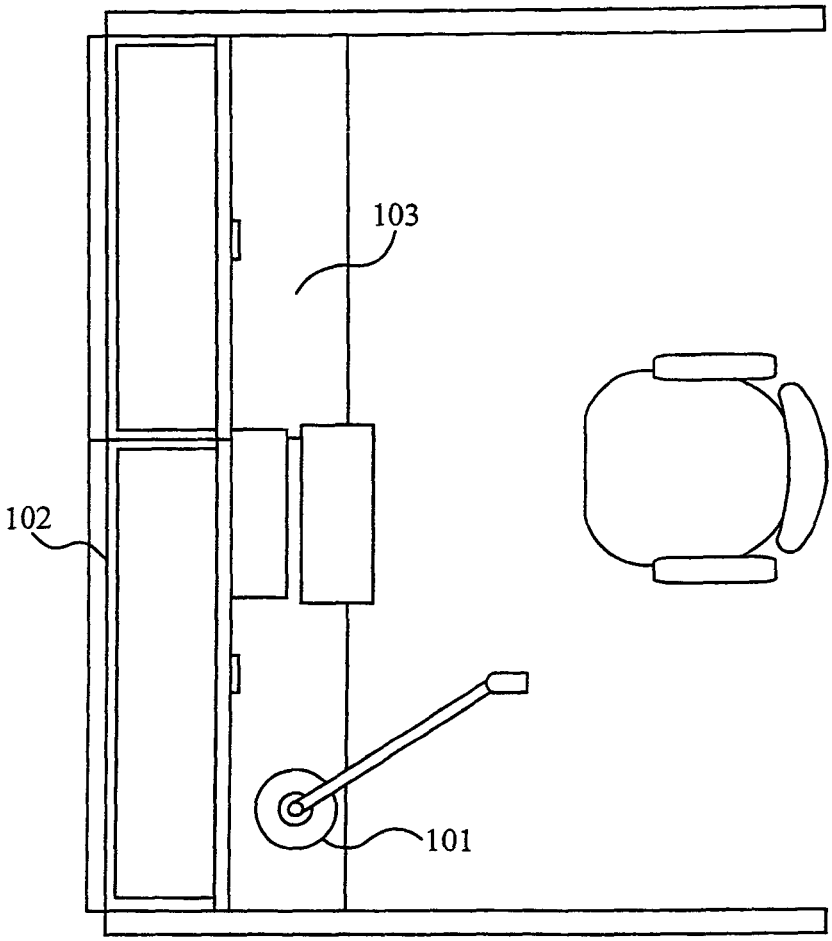
FIGS. 1A-C illustrate simplified drawings of typical work spaces.

The current invention is a device for work area illumination comprising luminaires, power supply, and lighting controls. Specifically, the current invention is a system of task luminaires and supporting components for the purpose of illuminating a limited segment of a larger office area. In the current invention, lighting for both horizontal and vertical illumination of work areas is provided through a device for work surface illumination comprising luminaires, power supply, and lighting controls. The luminaires of the current invention emit light in a variety of distributions. Combinations of task-specific luminaires can be tailored to match the space, while maintaining a uniform interface and appearance. The current invention considers both the aesthetic and quantitative aspects required to generate even and pleasing workplace lighting. The aesthetic aspect ensures that all the luminaires in the space are of a similar appearance, pleasing shape, and are designed to minimize negative lighting effects, such as glare. The Illuminating Engineering Society (IES) of North America published guidelines for light levels for many tasks and activities based on the nature of the task, the size of the objects handled, the detail required, the average age of the people in that space, and other factors. The typical office is lit to an illumination of 20 to 70 "foot-candles." This large range highlights the difference between the minimum lighting required for basic tasks and the higher levels needed in more visually intensive tasks or situations. Quantitatively, the current invention provides sufficient additional light to bring illumination levels from the lower range of office lighting to the upper range.

A major advantage of the lighting provided by the current invention is that light levels are increased exactly where they are needed. Existing task lamps often provide much more than the IES recommended illumination, while simultaneously leaving other parts of the workspace without any additional lighting. The current invention uses a number of less powerful luminaires placed throughout the space to provide appropriate illumination at all desired locations.

The current invention provides more effective and efficient lighting, especially when combined with an overhead lighting system that illuminates the space to a relatively low level. Luminaires with a traditional task distribution can be used for high levels of illumination when doing high-detail work. Lower-power versions of traditional task lights, as used in the current invention, can provide a similar function, but use as little as 35% of the energy a traditional task solution. These low power levels are practical for LEDs sources, but can not be achieved with traditional lighting sources such as incandescent or fluorescent.

The current invention provides more effective lighting with increased system efficiency. Specifically, the current invention discloses a device for work surface illumination comprising a plurality of luminaires, a power supply, and a plurality of lighting controls. The device for work surface illumination disclosed achieves a series of objectives: increased illumination of horizontal surfaces; increased illumination of vertical surfaces; increased illumination of accent items; efficient distribution of light across a work area; ease of fabrication, shipping, installation, and repair; user adjustability and customization; various mounting configurations to meet a broad range of applications including, but not limited to, under cabinet, desktop, desk clamp, or furniture mounted; and long-life performance.

In the current invention, a plurality of luminaires provides the possibility for a plurality of lighting distributions including, but not limited to, task, wall wash, accent, and spot. Further, the current invention comprises a means for providing lighting from a plurality of light sources with a plurality of lighting distributions.

In other embodiments of the current invention, the device for work surface illumination comprises a plurality of luminaires with a plurality of lighting distributions. Each luminaire comprise a mounting structure and an optical element coupled to the mounting structure. In addition, the luminaire comprises a means for providing light coupled to the optical element. Further, the device comprises a power source coupled to the luminaires. Also, the device comprises a means for controlling the luminaires and power supply coupled to the power supply or luminaires. The means for controlling the luminaires and power supply uses a plurality of inputs including, but not limited to, input from the user, detection of an occupant, light level, temperature, computer interface, and/or time.

Thus, the current invention provides more effective and efficient lighting for a workspace. Further, the current invention has the added benefits of lower total system cost, ease of assembly and shipping, providing increased light levels where needed, faster installation times, and reducing and making repair and maintenance easier. In sum, the current invention provides targeted illumination, accommodates a variety of uses, is glare free, and provides these benefits in spaces of varying configuration and layout where it is currently either impossible or not desirable to use of prior task lighting.

Figure 1B:
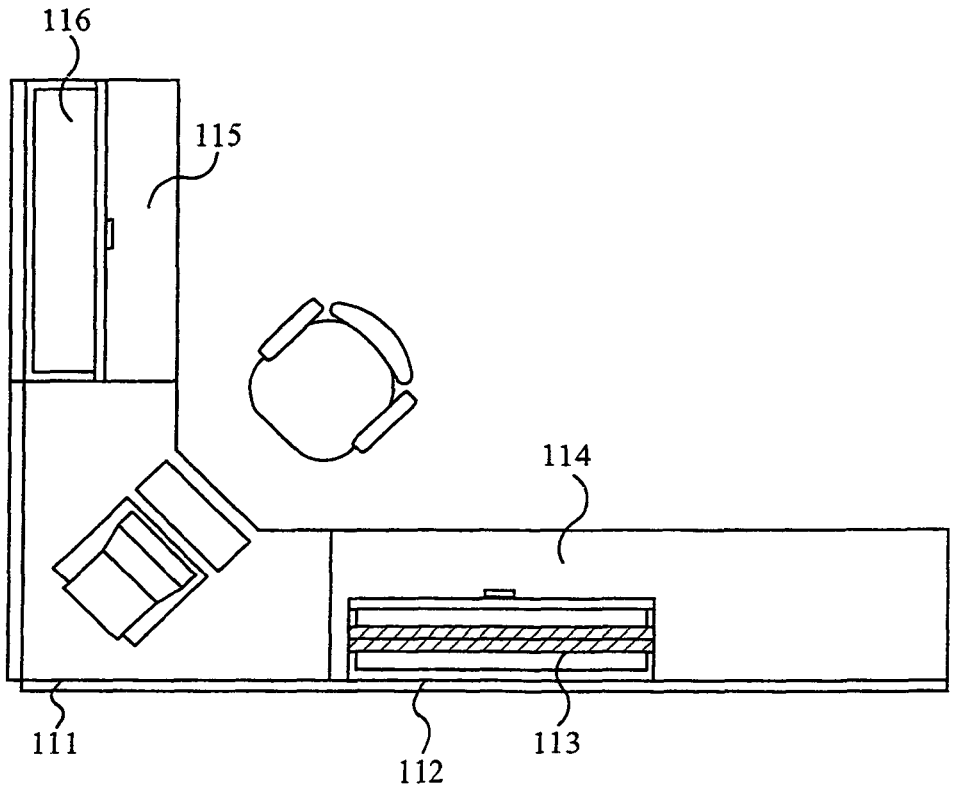
Figure 1C:
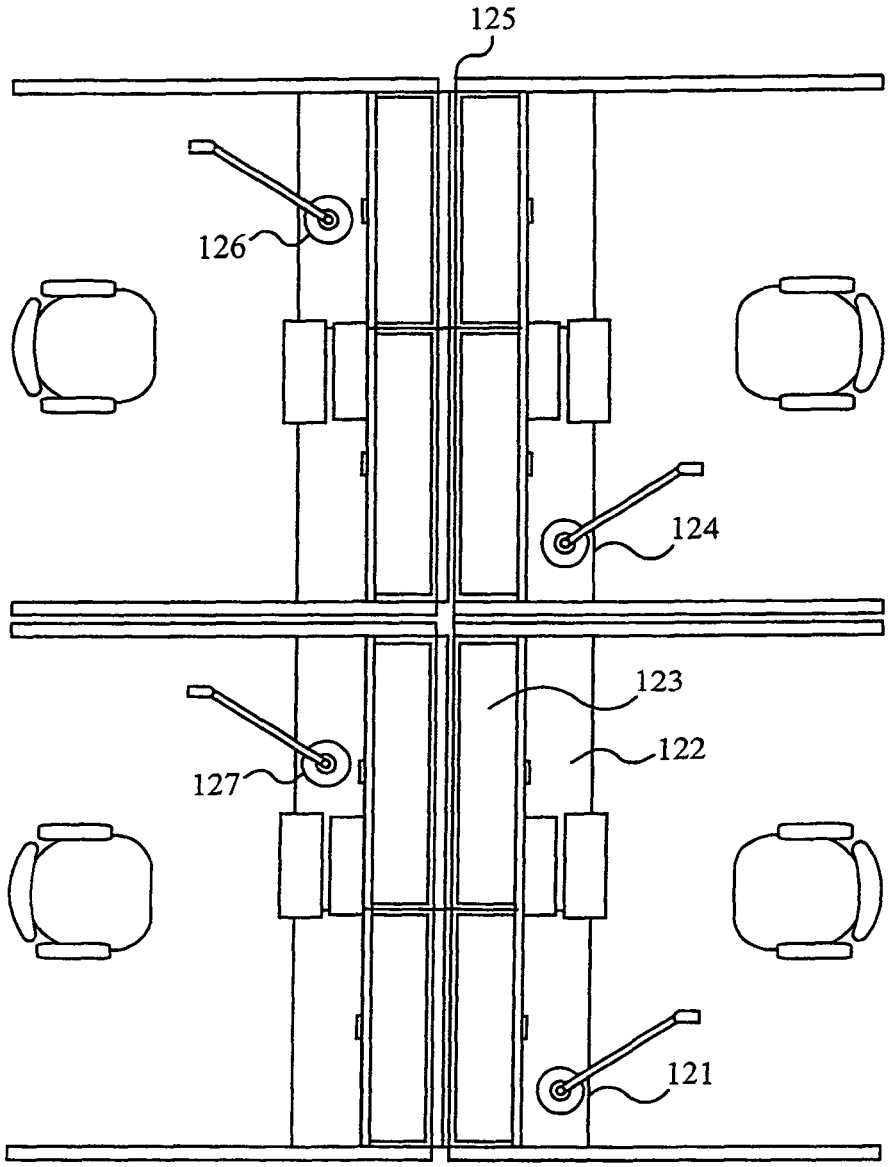

Now referring to FIGS. 1A-C that illustrate simplified drawings of typical cubical and task lighting layouts in accordance with the present invention. Specifically, FIG. 1A illustrates a small 6' by 8' individual cubical 102, illuminated by a task lamp 101, with the desk area farthest from the task lamp 103 receiving no significant illumination from the task lamp. FIG. 1B illustrates a larger 8' by 10' cubical layout 111, with a first binder bin 112 and a second binder bin 116, illuminated by an under-cabinet luminaire 113. The desk surface underneath under-cabinet luminaire 114 is lit to an excessively high level. The desk surface farthest from the under-cabinet luminaire 115 receives no significant illumination from under-cabinet lamp. FIG. 1C illustrates a group of linked cubicals 125, such as in a call center. The group of linked cubicals is illuminated by a set of luminaires 121, 124, 126, 127. The desk area across from the luminaire 121 (122) is an example of a poorly lit space. A binder bin 123 contributes to a lower light level on the desk area 122. The energy used per luminaire in these examples is typically between 12 and 32 Watts.

Figure 1D:
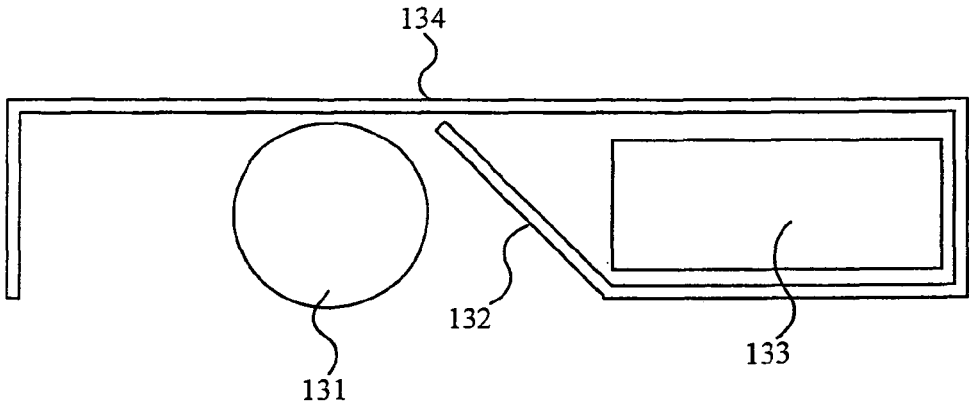
FIGS. 1D-E illustrate simplified drawings of prior art lighting fixture types.
Figure 1E:
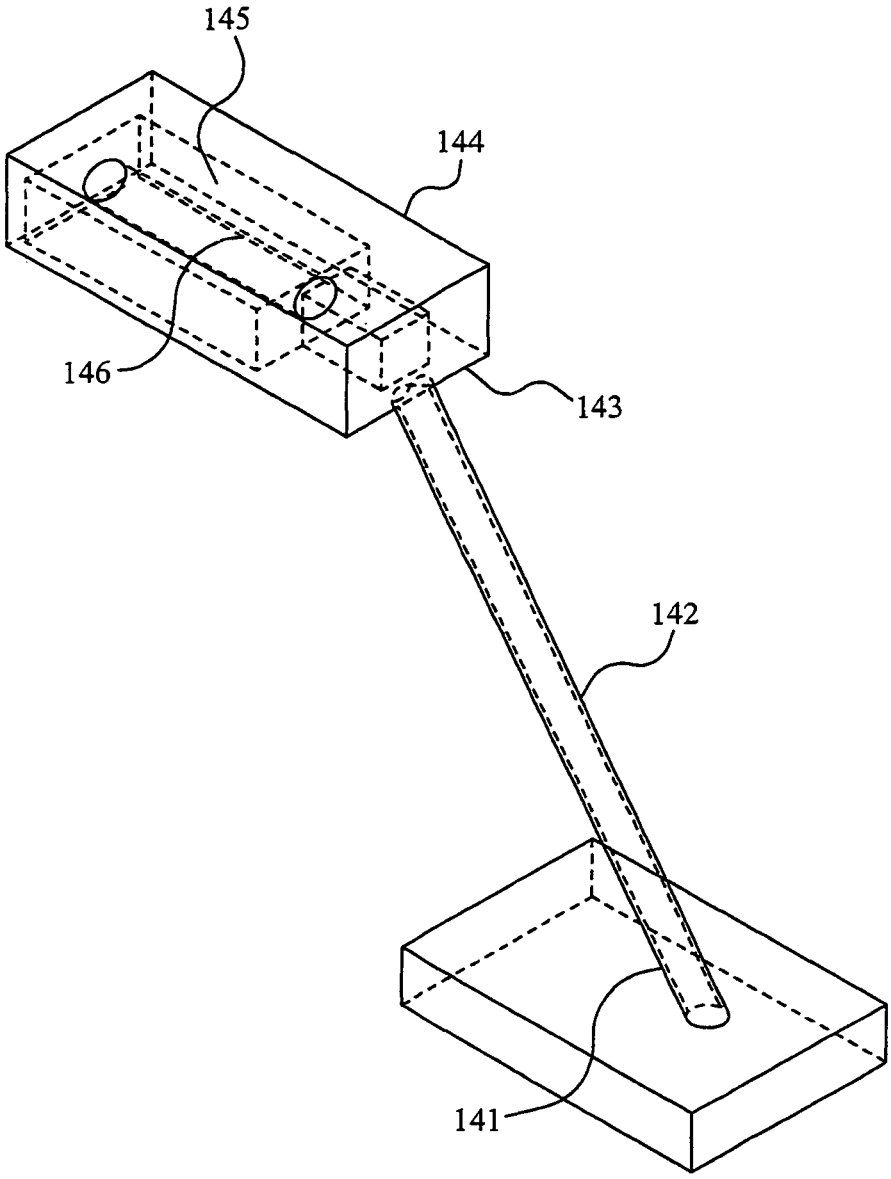

FIG. 1D-E illustrate typical prior art luminaires. Specifically, FIG. 1D illustrates an under-cabinet luminaire. The under-cabinet luminaire is composed of a lamp 131, reflector 132, ballast 133 and housing 134. The lamp 131 is typically a 'T8', a 1" diameter fluorescent tube. The size of the lamp 131 typically requires the housing 134 to be at least 1" tall. The ballast 133 converts alternating current from the wall (not shown) to the appropriate voltage to power the lamp 131. FIG. 1E illustrates a task lamp. The task lamp. A base 141 supports the task lamp. The base 141 is connected to the lamp head 144 by an arm 142. The lamp head supports a ballast 143, reflective cavity 145, and lamp 146. The lamp 146 is typically a bent fluorescent tube using between 7 and 18 Watts of energy.

Figure 2A:
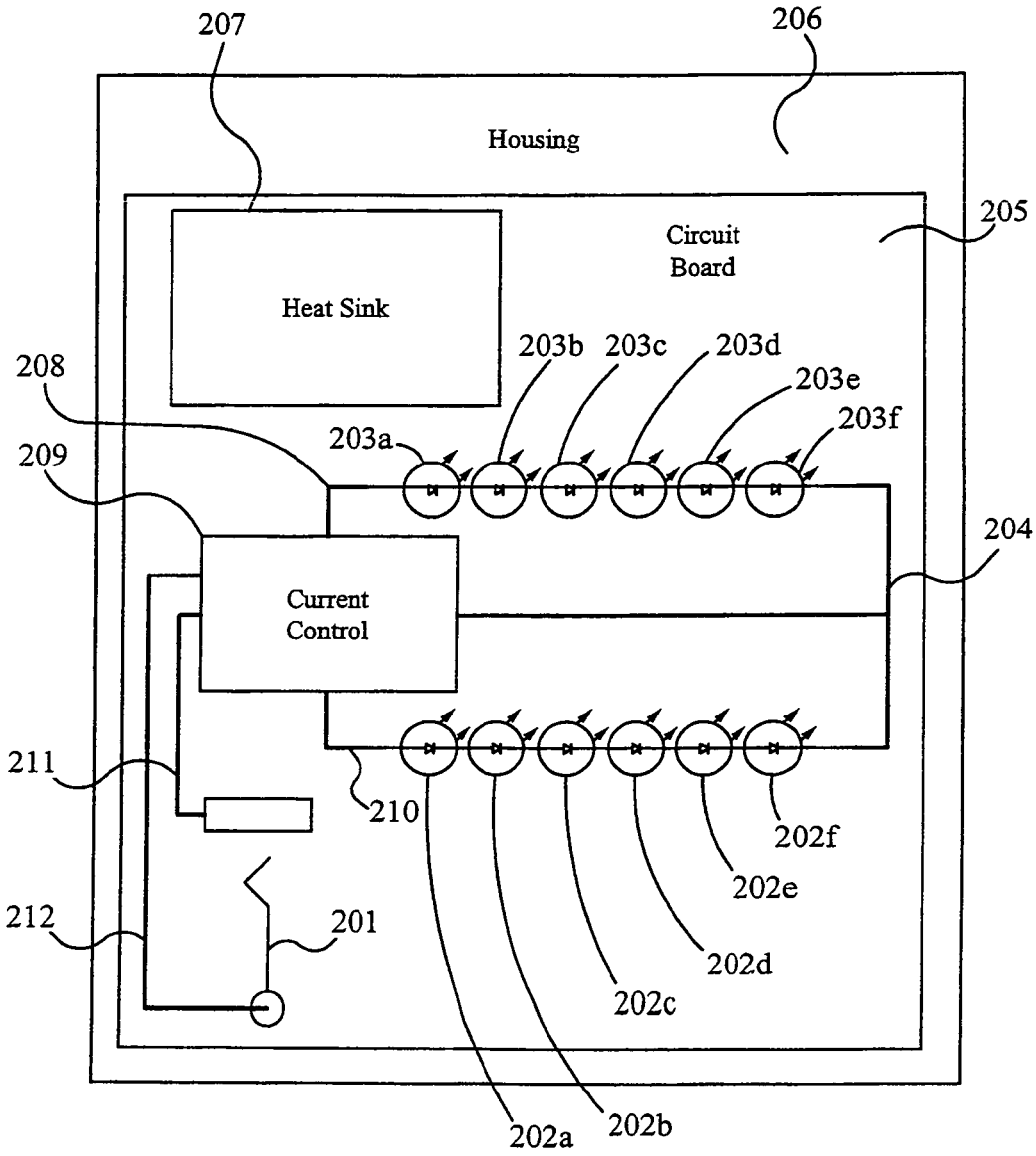
FIG. 2A illustrates a detailed schematic of the preferred modular luminaire structure, in accordance with the instant invention.

FIG. 2A illustrates a detailed schematic of the preferred modular luminaire structure, in accordance with the instant invention. Specifically, the luminaire comprises a housing 206 and a circuit board 205. The circuit board 205 is attached to the housing 206 and is further attached to a means for current control 209 and a DC power jack 201. The DC power jack 201 is electrically connected to the means for current control through a first electrical connection 212 and a second electrical connection 211. The preferred embodiment of the system utilizes different form factors for the DC power jack 201 to indicate the amount of current used by the modular luminaire.

The circuit board 205 is further connected to Light Emitting Diodes (LEDs) 202*a-f*, 203*a-f*. In the preferred embodiment of the system, the LEDs are electrically connected in series to match the voltage drop across the Light Emitting Diodes 202*a-f*, 203 *a-f* to the voltage applied to the DC power jack 201. Each series of LEDs 202*a-f*, 203*a-f* is then further wired in parallel. The means for current control 209 is connected to a first string of LEDs 202*a-f* by a first means for electrical connection 208 and to a second string of LEDs 203*a-f* by a second means for electrical connection 210. Both strings of LEDs 202*a-f*, 203*a-f* are further connected to the means for current control 209 by a third means for electrical connection 204. This structure allows the use of simple current regulation strategies, such as linear regulation, in an efficient manner. The structure further ensures the LEDs 202*a-f*, 203*a-f* all experience very similar current flows to ensure similar operating characteristics.

The luminaire further comprises a heat sink 207 that is mechanically attached to the circuit board 205 and provides cooling for the means for current control 209 and the LEDs 202*a-f*, 203*a-f*. In the preferred embodiment, the heat sink 207 is integrated into a portion of the housing 206.

Figure 2B:
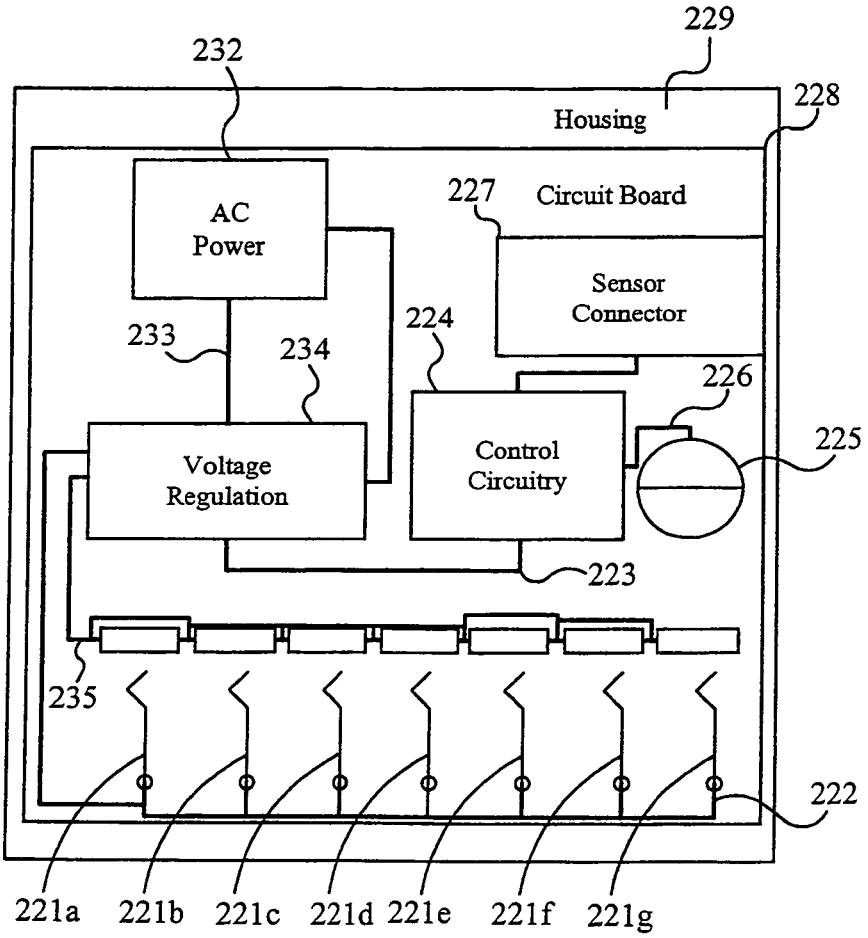
FIG. 2B illustrates a detailed schematic of the preferred modular power supply structure, in accordance with the instant invention.

FIG. 2B illustrates a detailed schematic of the preferred modular power supply structure, in accordance with the instant invention. Specifically, the power supply comprises a housing 229 and a circuit board 228. The circuit board 228 is attached to the housing 229 and is further attached to: a means for connecting to AC power 232, a means for voltage regulation 234, a means for controlling the operation of the power supply 224, a means for connecting to a sensor 227, a means for indicating status 225, and a plurality of DC power jacks 221*a-g*. The power supply further comprises: a first means for electrical connection 222 and a second means for electrical connection 235 that electrically connect the means for voltage regulation 234 and the DC power jacks 221*a-g*, a third means for electrical connection 233 and a fourth means for electrical connection 231 that electrically connect the means for voltage regulation 234 to the means for connecting to AC power 232, a fifth means for electrical connection 223 that connects the means for voltage regulation 234 to the means for controlling the operation of the power supply 224, a sixth means for electrical connection 230 that connects the means for controlling the operation of the power supply 224 to the means for connection to a sensor 227, and a seventh means for electrical connection 226 that connects the means for controlling the operation of the power supply 224 to the means for indicating status 225.

In the preferred embodiment, the DC jacks 221*a-g* are of an identical size. The DC jacks 221*a-g* are further spaced evenly to allow an multi jack connector (not shown) to connect to any combination of a plurality of adjacent DC jacks 221*a-g*. The DC jacks 221*a-g* are further chosen to be a different size from the DC power jack 201 contained in the modular luminaire.

The DC jacks 221*a-g* and DC jack 201 are further chosen such that the total power from the power supply is evenly divided between DC jacks 221*a-g* to calculate the minimum luminaire power (not shown) and DC jack 201 is chosen to indicate multiples of the minimum luminaire power. The multi jack connector (not shown) is chosen to indicate the same multiple of the minimum luminaire power. Preferably, the total power from the power supply is chosen to be between 9 and 60 Watts. Also preferably, multiple power supplies are made available with different power ratings to accommodate different situations and make full use of the modular nature of the product.

The control circuitry 224 is designed to take inputs from the means for connecting to a sensor 227 and control the means for voltage regulation 234 by turning the means for voltage regulation 234 on and off. In the preferred embodiment, 24 Volts is produced by the means for voltage regulation 234. The control circuitry 224 is further designed to indicate the status of the system using the means for indicating status 225. In the preferred embodiment, the means for indicating status 225 is a red LED mounted such that it is visible outside of the housing 229. The means for indicating status 225 is turned on to indicate normal operation and is flashed to indicate abnormal conditions.

Figure 2C:
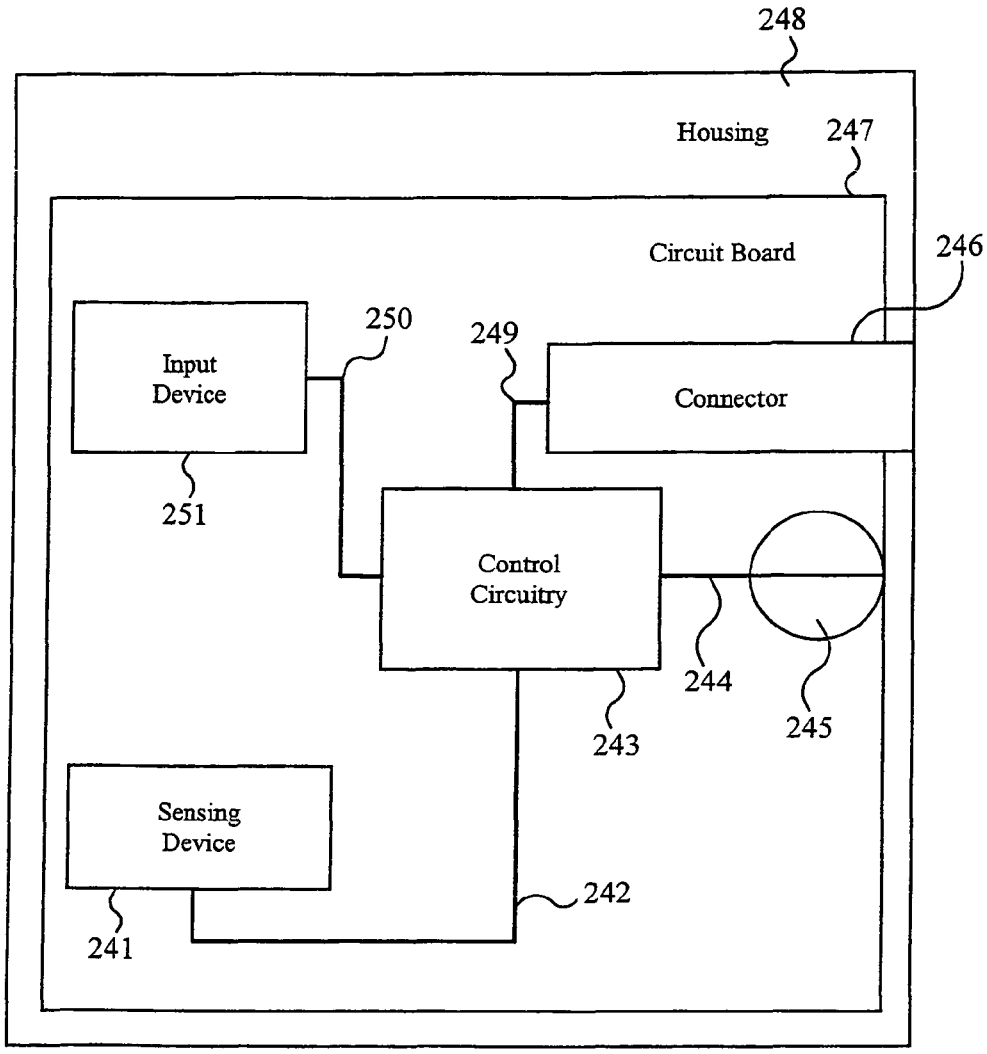
FIG. 2C illustrates a detailed schematic of the preferred modular controller structure, in accordance with the instant invention.

FIG. 2C illustrates a detailed schematic of the preferred modular controller structure, in accordance with the instant invention. Specifically, the controller comprises a housing 248 and a circuit board 247. The controller further comprises: an input device 251; a connector 246; a sensing device 241; an indicator 245; and a means for controlling the controller 243. The controller also comprises: a means for connecting the input device 251 to the means for controlling the controller 243; a means for connecting the sensing device 242 to the means for controlling the controller 243; a means for connecting the connector 246 to the means for controlling the controller 243; and a means for connecting the indicator 245 to the means for controlling the controller 243.

In the preferred embodiment, the input device 251 is a push button switch. The switch indicates the desire to turn the modular power supply off. The sensing device 241 is preferred to be an occupancy sensor, and is preferred to be calibrated to detect occupants in the range 0-8' from the sensing device 241. The connector 246 is preferred to be a RJ11 connector and transmit signals including, but not limited to, power, ground, occupancy status, and input device status. In other embodiments, the connector 246 is a RJ45 connector, and in further other embodiments the connector 246 is eliminated and replaced by a means for connecting the controller to the power supply (not shown). It is also preferred that the indicator 245 is a red LED that lights when the sensing device detects a signal, such as the preferred occupancy sensor detecting motion.

Figure 3A:
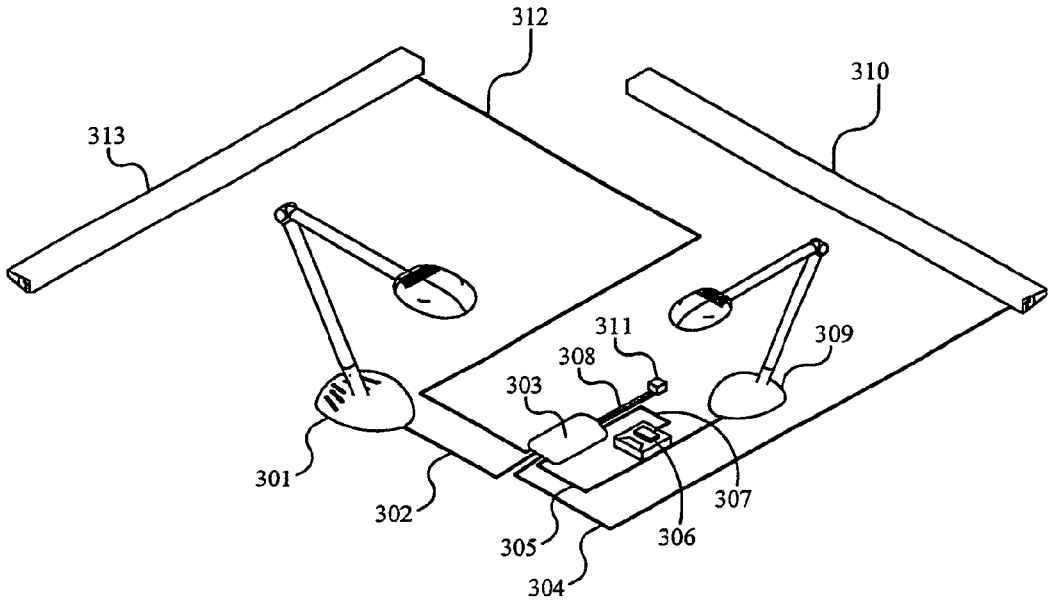
FIG. 3A illustrates a detailed drawing of a device for work area illumination comprising luminaires, power supply, and lighting controls, in accordance with the instant invention.

FIG. 3A illustrates a detailed drawing of a device for work area illumination comprising luminaires, power supply, and lighting controls, in accordance with the instant invention. Specifically, the device for work area illumination comprises a plurality of luminaires for task, accent, or wall illumination 301,309,310, 313. The device further comprises a power supply 303 and a control device 306. Additionally, the device comprises a system of interconnection cables 302, 304, 305, 312 that connect the power supply 303 to the luminaires 301,309, 310, 313, and a means for connecting the power supply 303 to the control device 306. The system further comprises a power cord 311 that connects the power supply 303 to AC current from a standard wall outlet (not shown).

In the preferred embodiment, the luminaires 301, 309, 310, 313 are selected from the group consisting, but not limited to: 6-Watt task luminaire; 3-Watt accent luminaire; and 6-Watt wall wash luminaire. In the diagramed embodiment, one 6-Watt task luminaire, one 3-Watt accent luminaire, and two wall wash (under cabinet) luminaires are used to illuminate a space. In the preferred embodiment, users may select between a wide variety of luminaire types and power ranges. Additionally, users may select a power supply 304 with a power rating appropriate for their work space. In the preferred embodiment, the power supply 304 is selected to meet or exceed the government recommended limit of 0.2 Watts per square foot.

To illustrate, in a small work environment as shown in FIG. 1A, the user may select a 9-Watt power supply. The total area of the cubical shown in FIG. 1A is 48 square feet. A 9-Watt power supply yields a power density of 0.1875 Watts per square foot. Similarly, a larger work area can use a 25-Watt power supply to illuminate a 125 square foot cubical. A set of work areas in a call center can combine to use a 60-Watt power supply to light a 300 square foot area. These power supplies are preferred to remain at or below 60-Watts to maximize the benefits of LED lighting and provide control to a manageable group of luminaires. Limiting the power to a low level, especially when combined with a low-level ambient lighting scheme for the entire building, can result in dramatic energy savings while actually increasing user satisfaction due to increased user control.

Figure 3B:
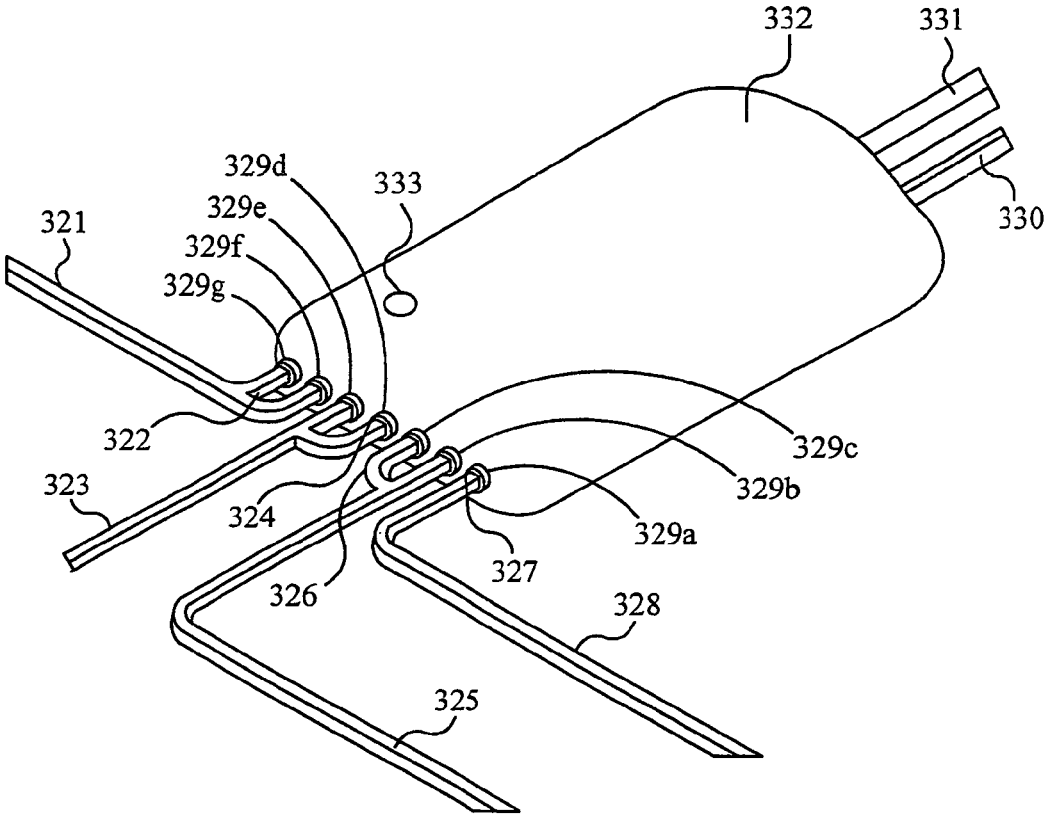
FIG. 3B illustrates a magnified, detail drawing of a power supply, in accordance with the instant invention.

FIG. 3B illustrates a magnified, detail drawing of a power supply, in accordance with the instant invention. Specifically, the power supply comprises a housing 332 containing circuitry (not shown), with an indicator light 333 and a plurality of connection jacks 329*a-g*. The power supply further comprises a power cable 331 connecting the power supply to AC current, and an input cable 330 connecting the power supply to the input device (see FIG. 3A).

Preferably, the connection jacks 329*a-g* are identical DC power jacks, evenly spaced. Connection cables 321, 323, 326, 328 are used to connect the power supply to the luminaires (shown in FIG. 3A). In the preferred embodiment, 3-Watt luminaires are connected using a single DC power jack, as shown by cable 328 meeting DC jack 329*a*. 6-Watt luminaires are connected using two DC power jacks, as shown by connector 322 meeting DC jacks 329*f-g*, connector 324 meeting DC jacks 329*d-e*, and connector 327 meet DC jacks 329*b-c*. In alternate embodiments, 9-Watt luminaires are connected using three DC power jacks.

In further alternate embodiments the unit of division is changed and 2-Watt luminaires are connected using one jack, 4-Watt luminaires are connected using two jacks, and 6-Watt luminaires are connected using three jacks. Further, it is possible to connect a luminaire that is between any power ratings using the number of jacks appropriate to the higher power rating.

Figure 3C:
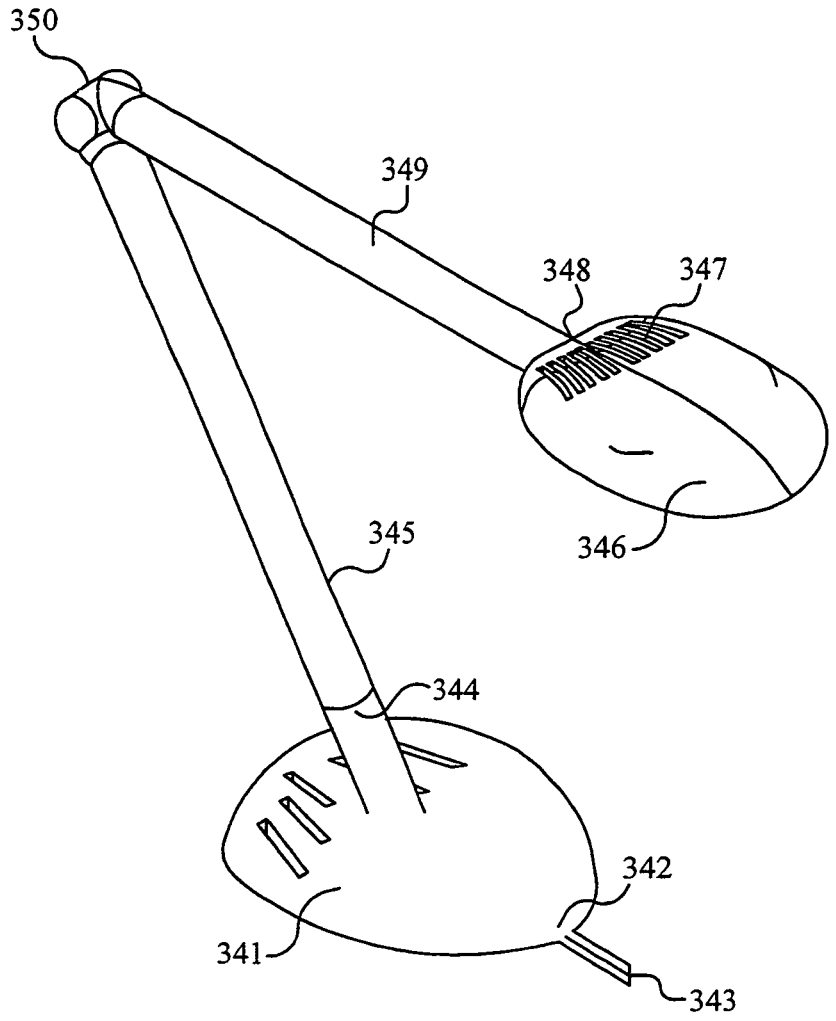
FIG. 3C illustrates a magnified, detail drawing of a task luminaire, in accordance with the instant invention.

FIG. 3C illustrates a magnified, detail drawing of a task luminaire, in accordance with the instant invention. Specifically, the task luminaire comprises a base 341 and a connector 342. The task luminaire further comprises a means for articulation 344, an arm 345, and second means for articulation 350, a second arm 349, a third means for articulation 348, a lamp head 346, and a heat sink 347.

In the preferred embodiment, a cable 343 from the power supply (see FIG. 3A) connects to the connector 342. The connector is preferably a DC power jack, with the size of the DC power jack indicating the power of the lamp. In the preferred embodiment, 3-Watt luminaires utilize a 1.3 mm DC power jack, 6-Watt luminaires utilize a 1.7 mm DC power jack, and the power supply utilizes 2.5 mm DC power jacks. The task luminaire is preferably a 6-Watt luminaire.

Preferably, the arm 345 and second arm 349 are of equal length and approximately 12" long. In this embodiment, the means for articulation 344, second means 350, and third means 348 combine to allow the lamp head 346 to be positioned appropriately for general task use. Specifically, they allow the lamp head 346 to be raised and lowered while remaining parallel to the horizontal work surface (not shown), and to be rotated around a vertical axis (not shown). Additionally, the means 344, 350, 348 allow the lamp head 346 to tilt up and down. In alternate embodiments, the luminaire may have only a single arm and two means of articulation.

In the preferred embodiment, the heat sink 347 is integrated into the lamp head 346. The lamp head 346 is constructed of aluminum and the heat sink 347 consists of slots cut into the lamp head 346. The heat sink 347 is preferred to be large enough to maintain the lamp head 347 at a temperature below 50 degrees C. It is further preferred for the temperature of the LED contained in the luminaire (see FIG. 2A) be maintained below 40 degrees C. Typically, this will lead to the total surface area of the heat sink 347 being approximately 10 square inches for each watt of power used in the lamp head 346. This will ensure the rated lifetime of the LEDs is met and prevent premature failure of the LEDs and thus the luminaire.

Figure 3D:
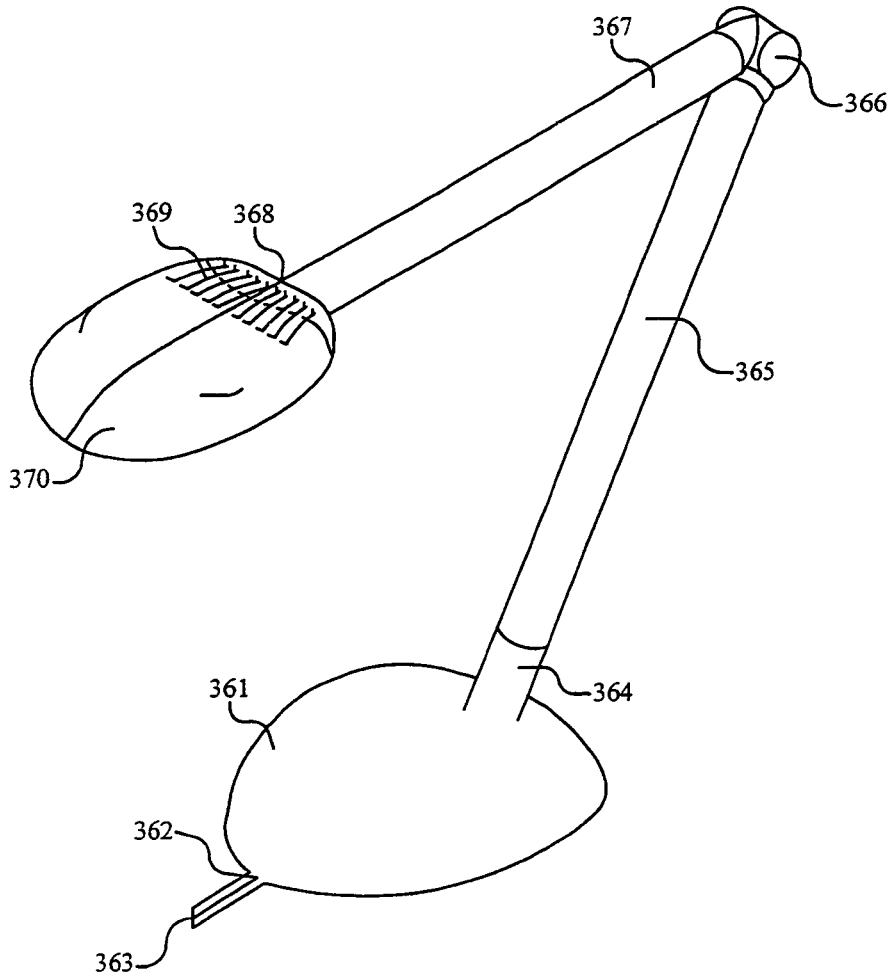
FIG. 3D illustrates a magnified, detail drawing of an accent luminaire, in accordance with the instant invention.

FIG. 3D illustrates a magnified, detail drawing of an accent luminaire, in accordance with the instant invention. Specifically, the accent luminaire comprises: a base 361; a connector 362; a means for articulation 364; an arm 365; a second means for articulation 366; a second arm 367; a third means for articulation 368; a accent head 370; and a heat sink 369. A cable 363 connects the luminaire to the power supply (see FIG. 3A). Preferably, the luminaire uses 3 Watts of power and the connector 362 is a DC power jack.

Preferably, the arm 365 and second arm 367 are of equal length and approximately 8" long. In this embodiment, the means for articulation 364, second means 366, and third means 368 combine to allow the accent head 370 to be positioned appropriately for accent use Specifically, they allow the accent head 370 to be raised and lowered while remaining parallel to the horizontal work surface (not shown), and to be rotated around a vertical axis (not shown). Additionally, the means 364, 366, 368 allow the accent head 370 to tilt up and down, and to rotate around the axis of the second arm 367 as shown in FIG. 3D. This allows the accent luminaire to light both horizontal and vertical surfaces in a pleasing manner. In alternate embodiments, the luminaire may have only a single arm and two means of articulation.

In the preferred embodiment, the heat sink 369 is integrated into the accent head 370. The accent head 370 is constructed of aluminum and the heat sink 369 consists of slots cut into the lamp head 370. The heat sink 369 is preferred to be large enough to maintain the accent head 370 at a temperature below 50 degrees C. It is further preferred for the temperature of the LED contained in the luminaire (see FIG. 2A) be maintained below 40 degrees C. Typically, this will lead to the total surface area of the heat sink 369 being approximately 10 square inches for each watt of power used in the accent head 370. This will ensure the rated lifetime of the LEDs is met and prevent premature failure of the LEDs and thus the luminaire.

Figure 3E:
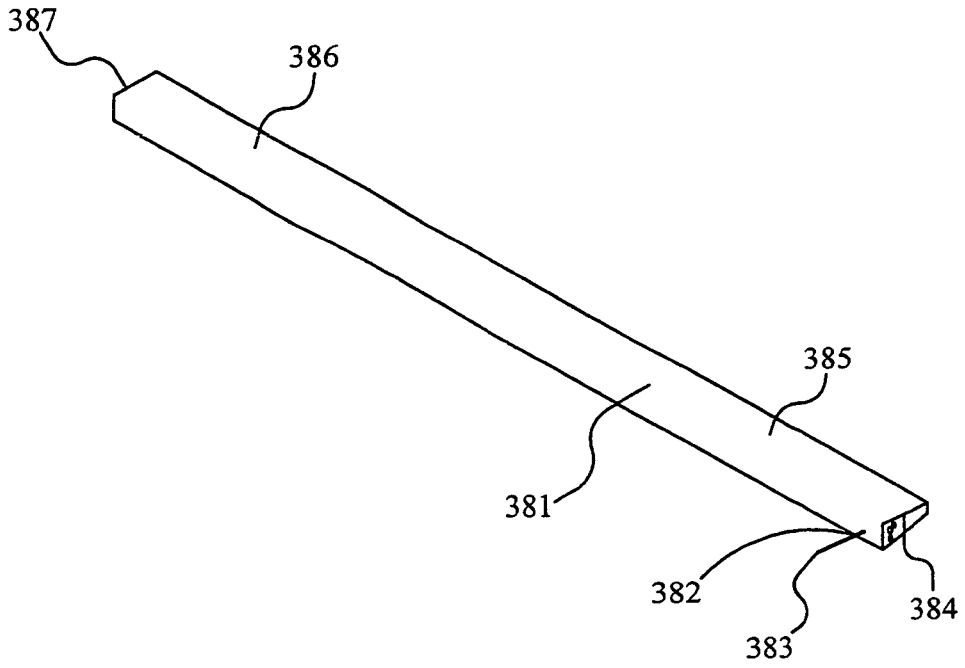
FIG. 3E illustrates a magnified, detail drawing of a wall wash luminaire, in accordance with the instant invention.

FIG. 3E illustrates a magnified, detail drawing of a wall wash luminaire, in accordance with the instant invention. Specifically, the wall wash luminaire comprises: a body 381; a connector 382; an endcap 384; a means for mounting 385; a second means for mounting 386; and a second endcap 387. The endcap 384 and second endcap 387 are connected to the body 381.

The means for mounting 385 and second means for mounting 386 each consist of a hole through the body 381. In alternate embodiments strips of adhesive-backed Velcro may be used to attach the luminaire to a cabinet or shelf (not shown). In further embodiments, magnets (not shown) may be mounted inside the body 381 to attach to a ferrous metal shelf, or to a ferrous plate attached to any surface. Screws may be used to attach the luminaire to the cabinet or shelf (not shown) through the holes.

In the preferred embodiment, the cable 383 from the power supply (see FIG. 3A) connects to the connector 382. The connector is preferably a DC power jack, with the size of the DC power jack indicating the power of the lamp. In the preferred embodiment, The task luminaire is preferably a 6-Watt luminaire. In alternate embodiments the task luminaire is a 9-Watt luminaire. In further other embodiments, both 6 and 9-Watt luminaires are available for purchase and can be combined through the modular nation of the power supply. In the preferred embodiment the body 381 is 42.5" long and fits under a standard 4' nominal binder bin (not shown). In alternate embodiments, the luminaire is available in 2', 3', and 4' nominal lengths. These luminaires are each optimized to light different segments of wall space using a specific amount of power. The 4' luminaire is preferred.

Figure 3F:
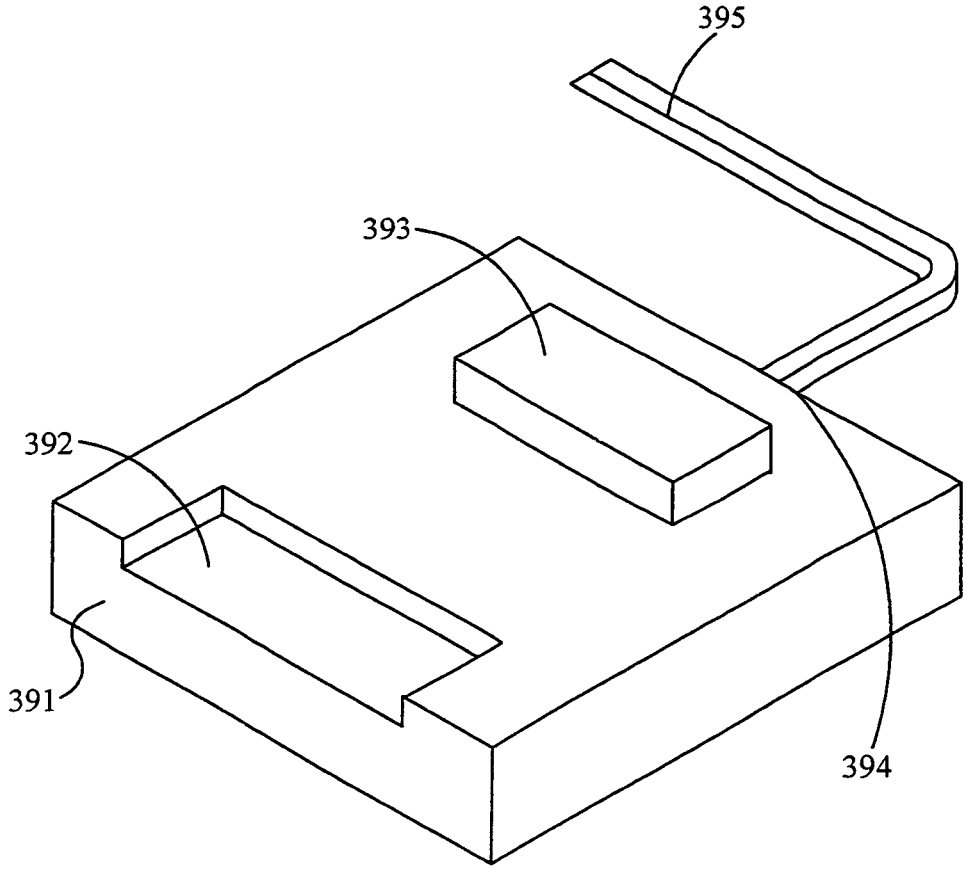
FIG. 3F illustrates a magnified, detail drawing of a controller, in accordance with the instant invention.

FIG. 3F illustrates a magnified, detail drawing of a controller, in accordance with the instant invention. The controller comprises a housing 391, a sensor 392, a means for input 393, and a connector 394. The housing is preferred to be gray or black and low profile. Typical outer dimension are 4.5" by 2.5" by 1". The means for input 393 is preferably a push button switch that controls all luminaires simultaneously and turns them all on or off. The sensor 392 is preferably an Infrared (IR) occupancy sensor with a 8' maximum range. It is preferred to connect the sensor to the power supply (see FIG. 3A) via the connector 394 and cable 395 (see FIG. 3A). The connector 394 is preferably RJ11. Alternate embodiments use a RJ45 connector or other data transmission method.

Figure 4A:
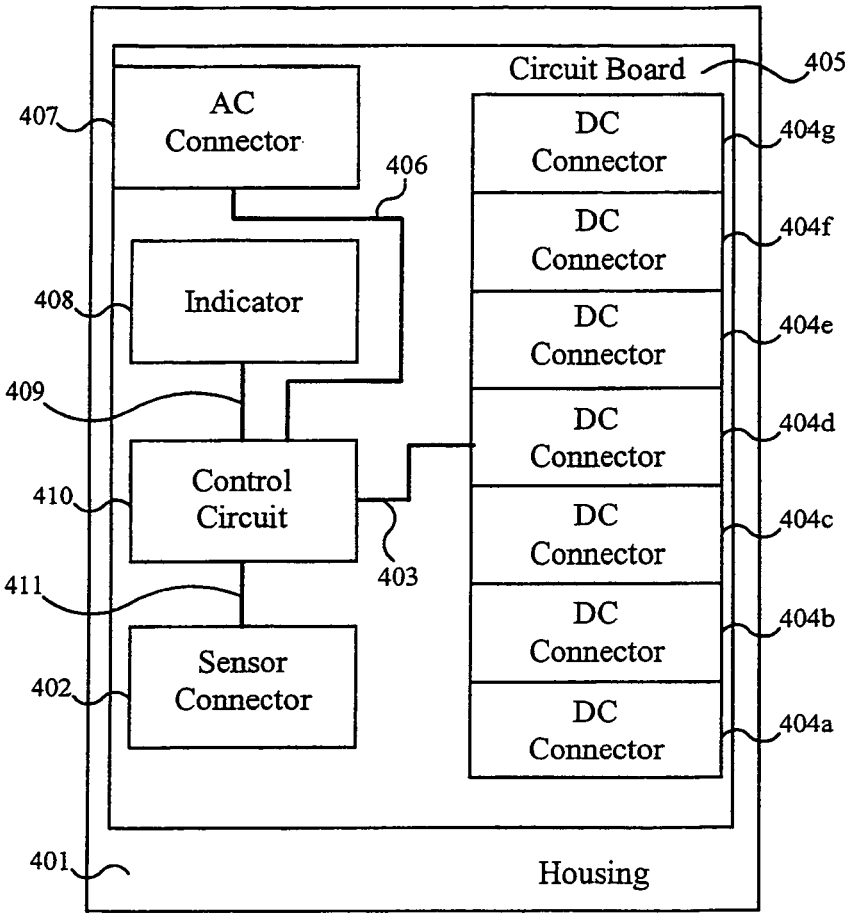
FIG. 4A illustrates a simplified functional drawing of a power supply, in accordance with the instant invention.

FIG. 4A illustrates a simplified functional drawing of a power supply, in accordance with the instant invention. Specifically, FIG. 4A clarifies the functional design of the power supply. The power supply is comprised of a housing 401; circuit board 405; sensor connector 403; DC connectors 404*a-g*; control circuit 410; indicator 408; and AC connector 407. The power supply further comprises a means for electrically connecting the AC connector 407 to the control circuit 410, a second means for electrically connecting the indicator 408 to the control circuit 410, a third means for connecting the sensor connector 403 to the control circuit 410, and a forth means for connecting the DC connectors 404*a-g* to the control circuit.

The circuit board 405 is mounted inside the housing 401 and further provides physical support for all other items listed above that comprise the power supply. The DC connectors 404*a-g* provide a means to connect to luminaires (not shown) and provide power for LEDs contained in the luminaires (not shown). The preferred embodiment uses standard DC power jacks for this purpose. The sensor connector 402 provides a means to connect to the means for controlling the power supply (see FIG. 3A). The AC connector 407 is preferred to be a plug-type rather than hardwired, which allows the power supply to be easily installed. The AC connector 407 is preferred to be a smaller size than a standard NEMA wall outlet plug to allow the AC power cord (see FIG. 3A) to fit through smaller spaces.

Figure 4B:
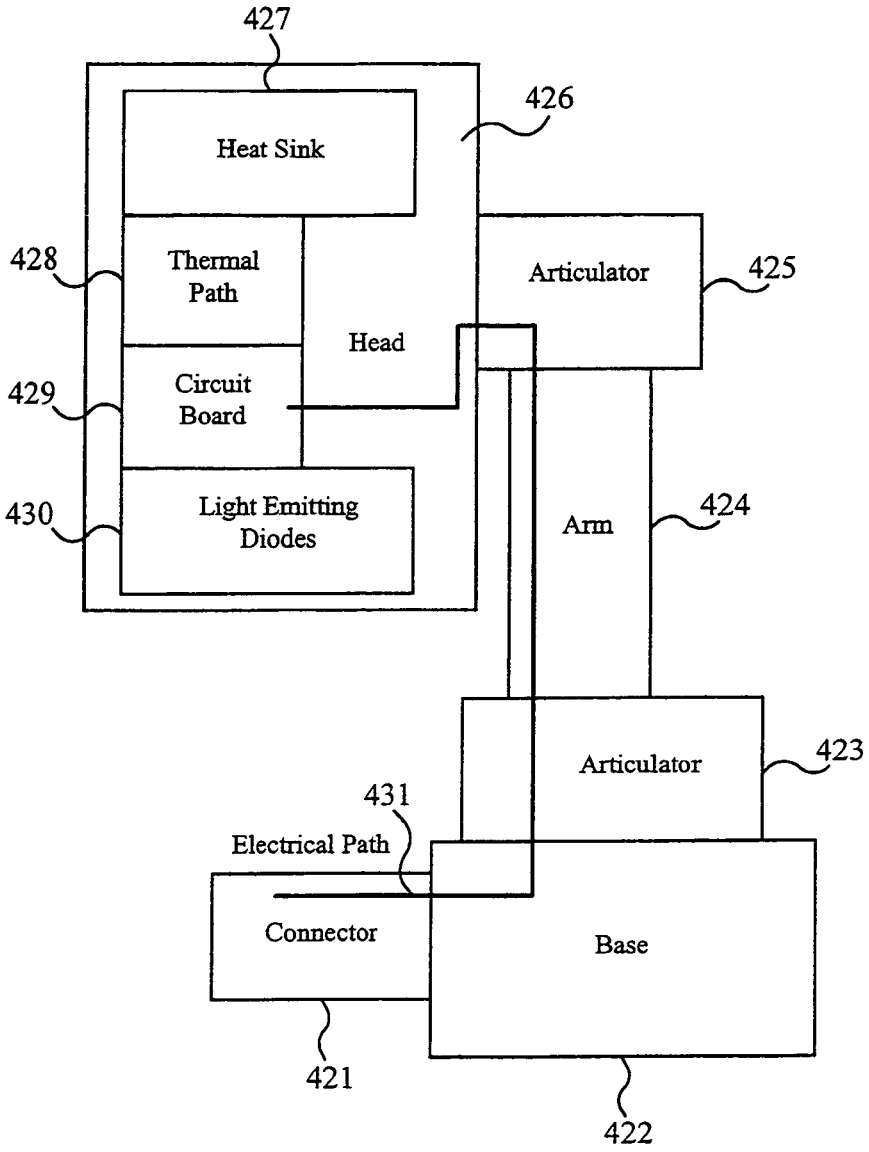
FIG. 4B illustrates a simplified functional drawing of task or accent luminaire, in accordance with the instant invention.

FIG. 4B illustrates a simplified functional drawing of task or accent luminaire, in accordance with the instant invention. Specifically, FIG. 4B clarifies the functional design of the luminaire. The luminaire is comprised of a base 422; a connector 421; a first articulator 423; an arm 424; a second articulator 425; a head 426; a circuit board 429; a plurality of LEDs 430; a thermal path 428; a heat sink 427; and an electrical path 431. The base 422 provides support for the luminaire. It is preferred to be substantially flat and heavy to provide stability and support for the luminaire. In other embodiments the base 422 may clamp to a table (not shown) or integrate directly with furniture systems (not shown). The first articulator 423 and second articulator 425 are preferred to provide 2 or 3 degrees of freedom of movement. In combination, the articulators 423, 425 allow the head 426 to be positioned freely in the space. In the preferred embodiment, the arm 424 raises the head 426 away from the work surfaces and allows the light emitted from the LEDs 430 to illuminate the work area. In other embodiments, a second arm and third articulator provide additional motion.

Figure 4C:
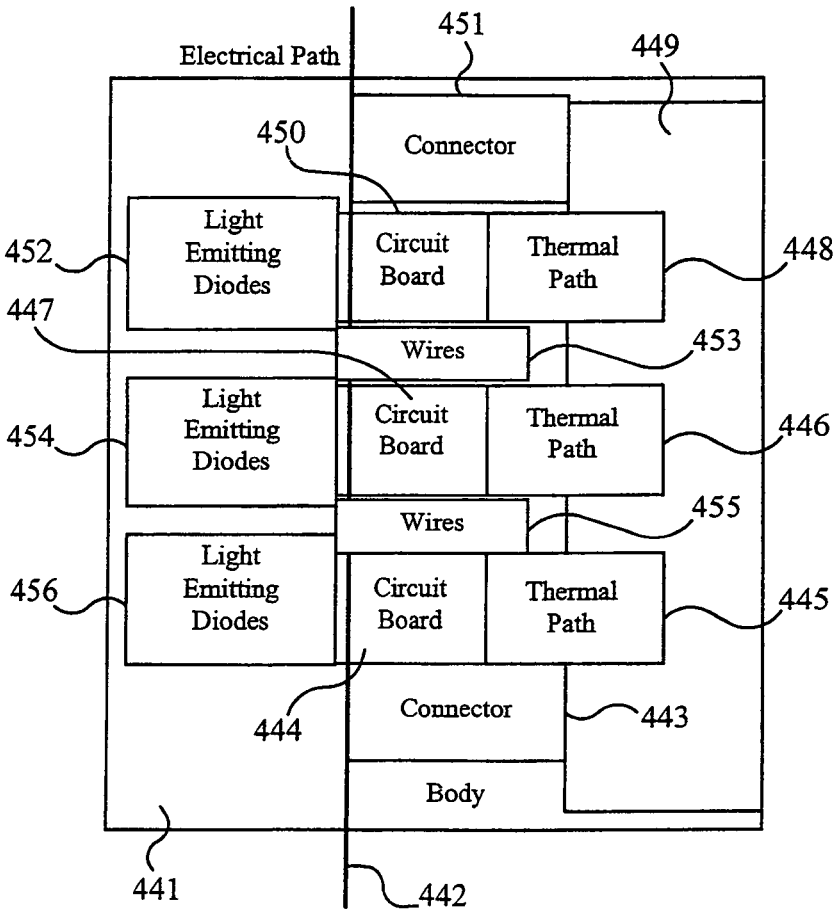
FIG. 4C illustrates a simplified functional drawing of a wall wash luminaire, in accordance with the instant invention.

The connector 421 is designed to allow luminaires of the same power rating to interface with the rest of the device (see FIG. 3A) in an identical fashion. This provides the user with flexibility in their luminaire choice and allows them to select appropriate luminaires for their work space. In the preferred embodiment, the electrical path 431 comprises two wires that bring electrical power from the connector 421 to the circuit board 429. The circuit board 429 provides mechanical support for the LEDs 430 and additionally provides electrical connection from the electrical path 431 to the LEDs 430. In the preferred embodiment, the circuit board 429 contains further power regulation circuitry to drive the LEDs 430 at a constant current (see FIG. 2A). The thermal path 428 connects the circuit board 429 to the heat sink 427 and ensures the LEDs 430 are maintained at an appropriate temperature. In the preferred embodiment, the temperature is 40 degrees C. FIG. 4C illustrates a simplified functional drawing of a wall wash luminaire, in accordance with the instant invention. Specifically, the wall wash luminaire comprises: a body 441; an electrical path 442; a first connector 443; a second connector 451; a first, second, and third circuit board 444, 447, 450; a first, second, and third thermal path 445, 446, 448; a first and second set of wires 455, 453; a first, second, and third set of LEDs 456, 454, 452; a reflector 449; and an electrical path 442.

The body 441 provides mechanical support for the reflector 449. The reflector 449 supports the first, second and third circuit boards 444, 447, 450. The connectors 443, 451 are identical and allow connection from either end. In the preferred embodiment, daisy chaining of multiple luminaires is prevented by both mechanical and electrical means. The means from connecting the luminaire to the power supply (see FIG. 3A) is asymmetric and will not connect from one luminaire to a second luminaire (see FIG. 3A). The circuit boards 444, 447, 450 provide support and electrical connections for the sets of LEDs 456, 454, 452. Further, the first circuit board 444 contains circuitry to convert power from the power supply into constant current power to the LEDs. This power is transferred from the first circuit board 444 to the second and third circuit boards 447, 450 through wires 455, 453. The wires further electrically connect the first connector 443 to the second connector 451, as shown by the electrical path 442.

The sets of LEDs 456, 454, 452 generate heat (not shown), which is transferred to the circuit boards 444, 447, 450. The heat is further transferred to through the thermal paths 445, 446, 448 to the reflector 449. The reflector 449 convects and radiates the heat to the environment. In the preferred embodiment, the LEDs are maintained at or below 40 degrees C.

The current embodiment shows a first, second, and third circuit board. In alternate embodiments additional circuit boards (not shown) are added to further disperse the light and increase the uniformity of illumination on the task surface. In these alternate embodiments, five evenly spaced circuit boards (not shown) are used to light a 4' long surface. Each circuit board (not shown) supports and electrically connects two 0.5 Watt white LEDs (not shown). In other alternate embodiments, luminaires are made with increased power, using four 0.5 Watt white LEDs per circuit board (not shown). In further embodiments, luminaires are shortened to provide illumination for 2' or 3' long surfaces (not shown). It will be clear from the discussions above and below that luminaires can include any other type of LEDs or combination of LEDs with any suitable power requirement including, for example, 1-Watt white LEDs.

Figure 4D:
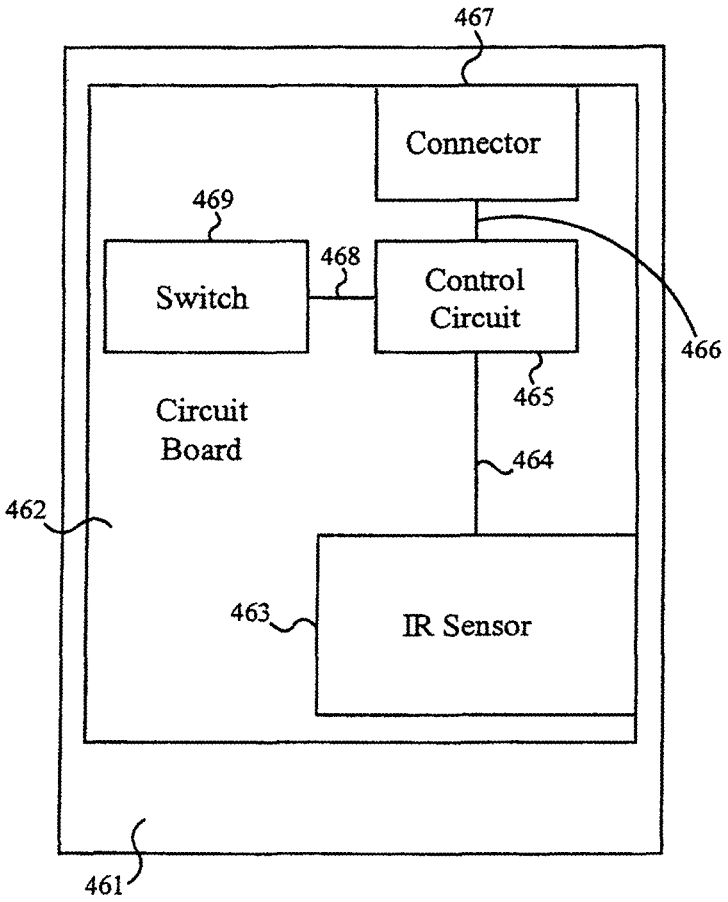
FIG. 4D illustrates a simplified functional drawing of a controller, in accordance with the instant invention.

FIG. 4D illustrates a simplified functional drawing of a controller, in accordance with the instant invention. Specifically, the controller comprises: a body 461; a circuit board 462; an IR sensor 463; a control circuit 465; a connector 467; and a switch 469. The controller further comprises: a means for connecting the IR sensor 463 to the control circuit 465 (464), a second means for connecting the switch 469 to the control circuit 46 (468); and a third means for connecting the connector 467 to the control circuit 465 (466). The body 461 provides support for the circuit board 462 and encloses all sensitive components. The connector 467 is typically a RJ11 connection and connects to the power supply (see FIG. 3A). The preferred embodiment uses the IR sensor 463 to detect occupancy of the work space. A signal (not shown) indicating the state of the occupancy is sent to the control circuit 465 using the means 464. A second signal (not shown) indicating the state of the switch 469 is sent to the control circuit 465 using the second means 468. The control circuit 465 provides power for the IR sensor 463 through the means 464 and processes the signals (not shown). The IR sensor 463 further sends signals to the power supply via the third means 466 and the connector 467 (see FIG. 3A).

The controller takes user input from the switch 469 and combines the input with information from the IR sensor 463. The controller then commands the power supply (see FIG. 3A) to turn the luminaires on or off. In alternate embodiments, the controller contains other sensors including, but not limited to, temperature, time, acceleration, or humidity sensor. In further alternate embodiments, the controller is integrated into the power supply. In the preferred embodiment, the sensor is place in an accessible location such that the user can depress the switch 469 and the IR sensor 463 can detect the user.

Figure 5A:
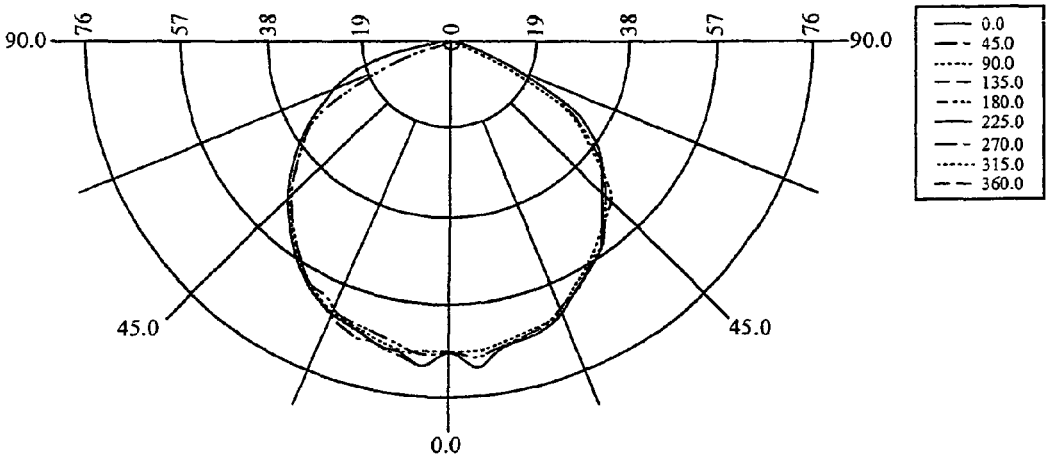
FIG. 5A illustrates a light distribution graph of the configured lighting provided by a task or accent luminaire, in accordance with the instant invention.

FIG. 5A illustrates a light distribution graph of the configured lighting provided by a task or accent luminaire, in accordance with the instant invention. A task luminaire will typically provide two to three more times the light output of an accent light, but the distribution of the light will be fairly similar. In other embodiments, the distribution graph is more asymmetric to provide a larger amount of illumination at a greater distance from the luminaire in the direction away from the luminaire base.

Figure 5B:
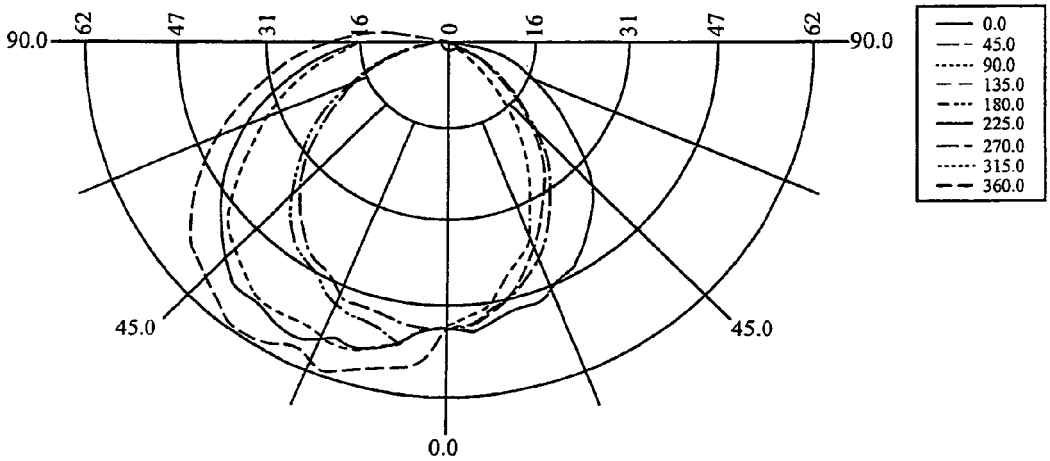
FIG. 5B illustrates a light distribution graph of the configured lighting provided by a wall wash luminaire, in accordance with the instant invention.

FIG. 5B illustrates a light distribution graph of the configured lighting provided by a wall wash luminaire, in accordance with the instant invention. In other embodiments this distribution may be further smoothed using diffusers or reflectors. Additionally, in other embodiments the wall wash luminaire may provide more or less total light output by using proportionally more or less LEDs.

Figure 6A:
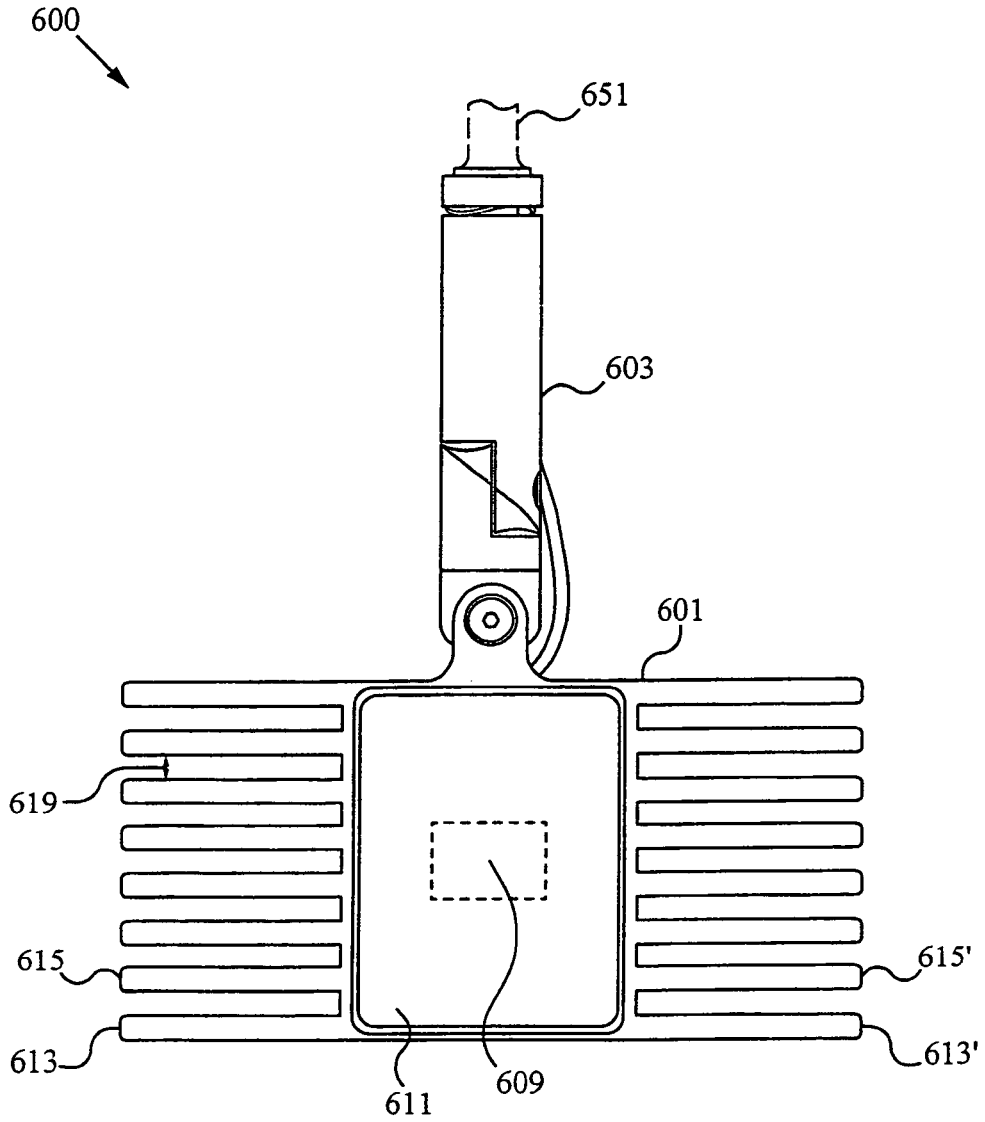
FIG. 6A illustrates a finned lamp head or luminaire head configuration, in accordance with the instant invention.
Figure 6B:
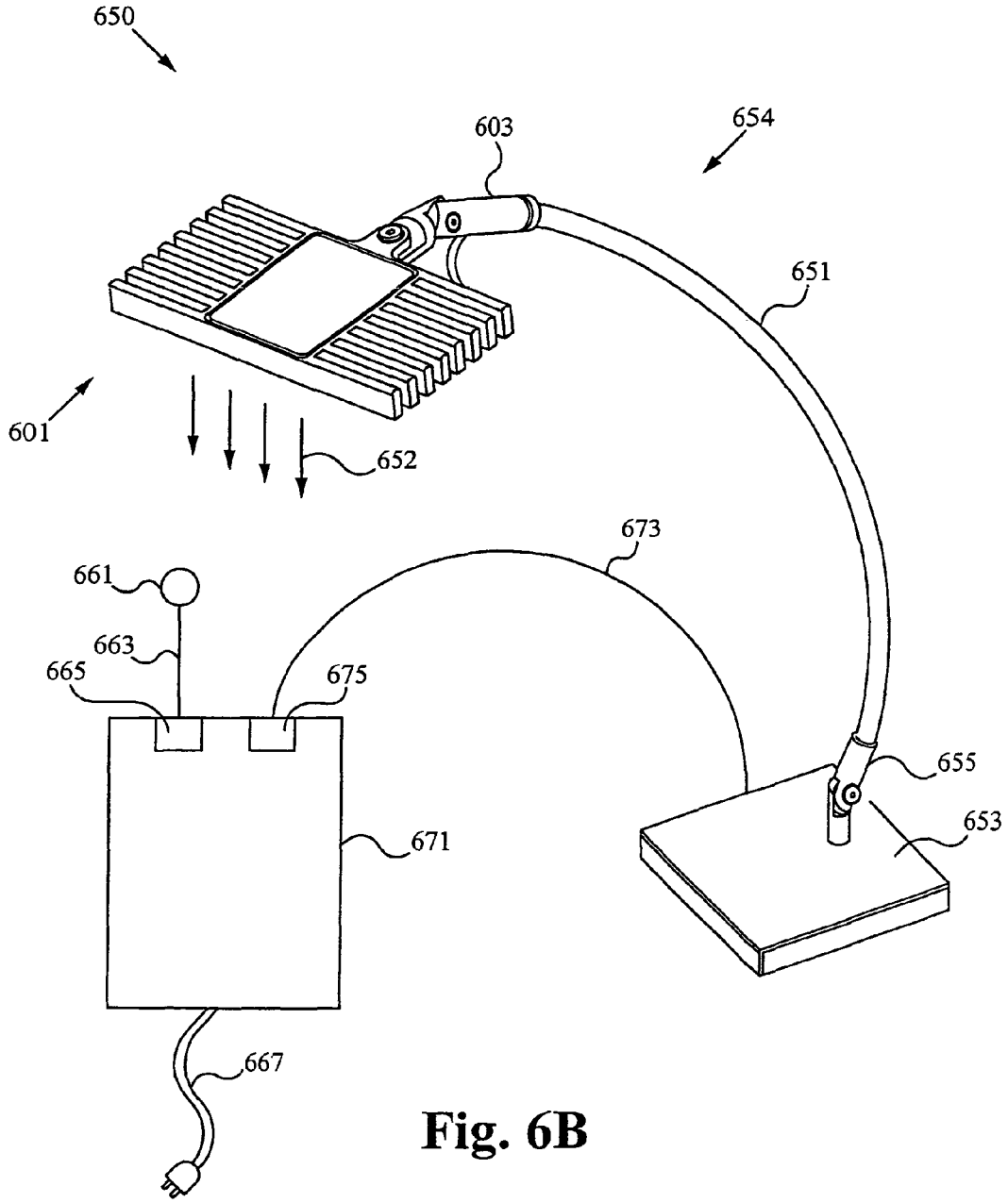
FIG. 6B illustrates a lamp or luminaire with finned lamp head or luminaire head configuration, in accordance with the instant invention.

FIG. 6A illustrates a lamp head or luminaire head configuration 600, in accordance with the instant invention. The lamp head or luminaire head configuration 600 includes a finned lamp head 601 that is made from a thermally conductive material, such as metal. The finned lamp head 601 has a heat sink portion 611. Embedded or seated within the heat sink portion 611 there is a light emitting diode or a light emitting diode array 609. The light emitting diode or light emitting diode array 609 is configured to emit light from the finned lamp head 601, as indicted by the arrows 652 (FIG. 6B). In accordance with the embodiments of the invention the lamp head or luminaire head configuration 600 includes an articulated neck portion 603 for attaching the finned lamp head 601 to a stem portion 651 and/or other support structure, which supports or suspends the finned lamp head 601 over a work space. The lamp head or luminaire head configuration 600, in accordance with further embodiments of the invention, is equipped with a clip or any other suitable attachment feature (not shown) for attaching the finned lamp head 601 to a shelf, a desk, or other workspace surface.

Still referring to FIG. 6A, the finned lamp head 601 has any number of fins 613, 615, 613' and 615'. The fins 613, 615, 613' and 615' are also made of a thermally conductive material, such as metal. The fins 613, 615, 613' and 615 are separated by a distance 619 sufficient to allow laminar convection flow of air between the fins 613, 615, 613' and 615 under normal conditions and thereby cool the light emitting diode or the light emitting diode array 609. Preferably, the fins 613, 615, 613' and 615 are separated by a distance 619 that is 1.0 mm or greater. The finned lamp head 601 is, therefore, also referred to as a convection air cooled light emitting diode luminaire. Preferably, the fins 613, 615, 613' and 615' are positioned on or extend outward from two or more opposed sides of the heat sink portion 611 of the finned lamp head 601. However, it will be clear to one skilled in the art from the discussion herein that fins, such as the fins 613, 615, 613' and 615', can completely surround a periphery of the heat sink portion 611 of the finned lamp head 601, protrude from a top surface of the finned lamp head 601, or protrude from a lower surface of the heat sink portion 611 of the finned lamp head 601, or any combination of configurations thereof. Also it will be understood that the while the finned lamp head 601 is shown in FIG. 6A as being rectangular shaped, the finned lamp head 601 can be any shape, including but not limited to, round shaped, oval shaped, square shaped, and triangular shaped.

FIG. 6B shows a task lamp system 650 in accordance with the embodiments of the invention. The task lamp system 650 includes a task lamp 654 with a finned lamp head 601, such as described above. The task lamp 654, in accordance with the embodiments of the invention, includes an articulated neck potion 603 that allows the finned lamp head 601 to be adjusted. In accordance with further embodiments of the invention, the task lamp 654 also includes a stem portion 651 that is connected to a base portion 653 for supporting the finned lamp head 601 over a work space, such that the finned lamp head 601 can emit light over a work space, as indicated by the arrows 652, when the task lamp 654 is powered on. In accordance with the embodiments of the invention, the stem portion 651 is coupled to the base portion 653 through a swivel hinge or a swivel joint 655 or any other suitable means.

Still referring to FIG. 6B, the task lamp system 650 further includes a power supply 671, such as described in detail above. The power supply 671 is configured to coupled to a power outlet through a power cord 667 and provide power to the task lamp 654 as well as other luminaires or task lamps (not shown) electrically coupled to the power supply 671. The task lamp 654 is electrically coupled to the power supply 671 through an interconnect cable 673 and an interconnect 675. The task lamp system 650 preferably also includes an occupancy sensor 661 that is also powered by the power supply 671. The occupancy sensor 661 is electrically coupled to the power supply 671 through an interconnect cable 663 and an interconnect 665. In operation the occupancy sensor 661 instructs the power supply 671 to control the task lamp 654 in response to detecting a person or persons at or near an area around the task lamp system 650. It will be clear to one skilled in the art that the occupancy sensor 661 can alternatively have its own power supply (not shown) and communicate with the power supply 671 to operate the task lamp 654 in response to detecting a person or persons at or near the area around the task lamp system 650 using wireless communication techniques.

Figure 6C:
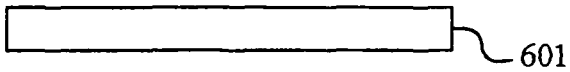
FIGS. 6C-F show different geometries of finned lamp head or luminaire head configurations, in accordance with the instant invention.
Figure 6D:
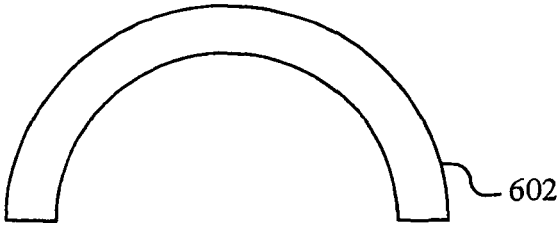
Figure 6E:
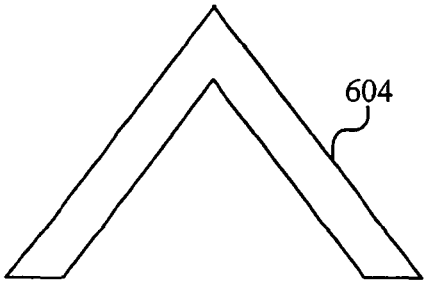
Figure 6F:
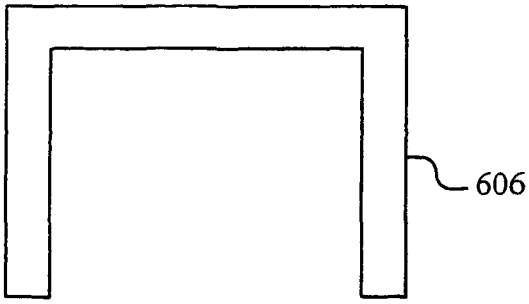

FIGS. 6C-F show different geometries or designs of finned lamp head or luminaire head configurations, in accordance with embodiments of the instant invention. FIG. 6C shows a front view of the flat finned lamp head 601, such as shown in FIGS. 6A-B; FIG. 6D shows a front view of a curved or contoured finned lamp head 602; FIG. 6E shows a front view of an angled or bent finned lamp head 604; and FIG. 6F shows a front view of a squared or right angle finned lamp head 606. It will be clear to one skilled in the art that the finned lamp head of the present invention can have any number of different geometries or designs and combinations of geometries or designs, including those described with reference FIGS. 6C-F above.

The current invention also discloses a system for providing task lighting. The system comprises a plurality of luminaires configured to output lighting in a work space, a power supply to limit the total power used in the work space, means for connecting the luminaires to the power supply, and means for controlling the power supply and luminaires. The plurality of luminaires comprises LEDs to provide illumination and circuitry to appropriately power the LEDs. In other embodiments, the circuitry is integrated into the power supply.

In addition, the current invention also disclosed a method of making task lighting systems. The preferred method comprises providing luminaires, power supply, and controls. The method further comprises limiting the power supplied to a work space through choice of a power supply. Additionally, the method comprises choosing task-specific luminaires to match the requirements of the work space. For example, a cubical with binder bins could utilize an under-counter luminaire, while a open desk in a private office would exchange the under-counter luminaire for a task luminaire.

There have been attempts to light work environments to low levels of ambient lighting. These have been resisted for a variety of reasons, one of which is the lack of adequate task lighting. Uncertain energy consumption, quality, and price of task lamps make them difficult to specify when designing a building. Poor standardization between different luminaires adds to difficulties when installing additional task lighting after buildings have been occupied. Further, maintaining a wide variety of task lighting solutions can be difficult and expensive.

In contrast to unregulated task lighting connected to a wall outlet, task lighting systems in accordance with the embodiments of the invention provide highly efficient and effective distribution of light across a work space. Further, the use of LEDs allows a much wider dispersion of light across the work space than traditional fluorescent sources. The modular nature of the current invention assures that all users in a building will be able to customize a solution to fit their work habits and personal environment. At the same time, the limits on the power supply ensure the total energy usage of the building can be planned in advance and the modularity of the system also allows easy maintenance and upgrades. Further, as tenants of a building change, the space can be easily reconfigured.

The present invention has been described in terms of specific embodiments incorporating details to facilitate the understanding of the principles of construction and operation of the invention. Such references herein to specific embodiments and details thereof is not intended to limit the scope of the claims appended hereto. It will be apparent to those skilled in the art that modifications may be made in the embodiment chosen for illustration without departing from the spirit and scope of the invention.

What is claimed is:

1. A lighting system comprising:

a) a power supply with a plurality of outlets, the power supply being configured to provide a fixed load to the plurality of outlets;

b) a plurality of light fixtures configured to electrically couple to one or more of the plurality of outlets, wherein each of the plurality of light fixtures includes an array of light emitting diodes and wherein at least one of the light fixtures includes a lamp head with a heat sink for cooling the corresponding array of light emitting diodes; and c) means for selecting the fixed load to the plurality of outlets.

2. The lighting system of claim 1, further comprising a sensor configured to automatically power the plurality of outlets in response to a condition.

3. The lighting system of claim 1, wherein the sensor is an occupancy sensor and the condition is detection of a person in a vicinity of the lighting system.

4. The lighting system of claim 1, further comprising means for providing an operating history of the system.

5. The lighting system of claim 1, wherein the means for providing an operating history of the system comprises a micro-processor and memory.

6. The lighting system of claim 1, wherein the plurality of outlets provides DC current to the plurality of light fixtures.

7. A device for lighting a workspace, the device comprising:

a) a plurality of luminaires, wherein each of the plurality of luminaires has a task-specific photometric outputs;

b) a dedicated power supply for providing electrical power to the plurality luminaires, wherein the power supply has an output power limit;

c) means for electrically coupling the luminaires to the power supply wherein at least one of the plurality of luminaires includes a light emitting diode; and d) means for individually selecting the power supplied to each of the plurality of luminaires.

8. The device of claim 7, wherein the output power limit is 120 Watts or less.

9. The device of claim 7, wherein the at least one of the plurality of luminaires has a finned lamp head with a heat sink and fins for cooling the light emitting diode.

10. The device of claim 7, wherein the means for controlling the power supplied includes an occupancy sensor.

11. The device of claim 7, wherein one or more of the plurality of luminaires have photometric outputs configured for providing task lighting, accent lighting, under-cabinet lighting, and wall wash lighting.

12. The device of claim 7, wherein the output power limit is selected from one or more of 6-Watt, 9-Watt, 15-Watt, 25-Watt, 30-Watt, 60-Watt, and 120-Watt.

13. The device of claim 7, wherein the means for electrically connecting the plurality of luminaires to the power supply includes universal interconnects.

14. A device for lighting a workspace, the device comprising:

a) a plurality of luminaires, wherein each of the plurality of luminaires has a task-specific photometric outputs;

b) a dedicated power supply for providing electrical power to the plurality luminaires, wherein the power supply has an output power limit; and c) means for electrically coupling the luminaires to the power supply wherein at least one of the plurality of luminaires includes a light emitting diode, wherein the means for coupling comprises:

I) a means for transmitting energy and/or data; and ii) a plurality of means for connecting the means for transmitting energy and/or data to a power supply and the luminaires, wherein the power supply is integrated into one of the luminaires; and d) a computer unit with a micro-processor and a memory unit for executing lighting programs.

15. The device of claim 14, wherein each of the plurality of means for coupling indicate a photometric type of the luminaires.

16. The device of claim 14, wherein the device is controlled by the system to control ambient lighting.

17. The device of claim 14, wherein the device controls the system to control ambient lighting.

18. The device of claim 14, further comprising means for communicating with a system to control ambient lighting.

* * * * *